US005923205A

United States Patent [19]

Shibata et al.

[11] Patent Number: 5,923,205

[45] Date of Patent: Jul. 13, 1999

[54] SEMICONDUCTOR ARITHMETIC CIRCUIT

[75] Inventors: Tadashi Shibata, 5-2, Nihondaira, Taihaku-ku, Sendai-shi, Miyagi-ken 982-02; Tadahiro Ohmi, 1-17-301, Komegabukuro 2-chome, Aoba-ku, Sendai-shi, Miyagi-ken 980; Masahiro Konda, Miyagi-ken, all of Japan

[73] Assignees: Tadashi Shibata; Tadahiro Ohmi, both of Miyagi-ken, Japan

[21] Appl. No.: 08/930,372

[22] PCT Filed: Apr. 1, 1996

[86] PCT No.: PCT/JP96/00882

§ 371 Date: Nov. 7, 1997

§ 102(e) Date: Nov. 7, 1997

[87] PCT Pub. No.: WO96/30853

PCT Pub. Date: Oct. 3, 1996

[30] Foreign Application Priority Data

Mar. 31, 1995 [JP] Japan ..... 7-076928

[51] Int. Cl.[6] ..... G06G 7/42

[52] U.S. Cl. ..... 327/361; 327/355; 364/769; 364/784.03; 364/784.04

[58] Field of Search ..... 327/355, 361, 327/407, 408; 364/768, 769, 773, 784.03, 784.04

[56] References Cited

U.S. PATENT DOCUMENTS

| | | | |
|---|---|---|---|
| 499,804 | 3/1991 | Nukiyama | 364/784.03 |
| 4,989,174 | 1/1991 | Gardei | 364/784.03 |
| 5,128,892 | 7/1992 | Ullrich | 364/784.03 |
| 5,148,387 | 9/1992 | Yano et al. | 364/784.03 |

FOREIGN PATENT DOCUMENTS 2-264381 10/1990 Japan .

*Primary Examiner*—Kenneth B. Wells
*Attorney, Agent, or Firm*—Randall J. Knuth

[57] ABSTRACT

A semiconductor arithemetic circuit which performs calculation of an analog vector with a high accuracy at a high speed. A semiconductor arithemetic circuit having a plurality of MOS type transistors, wherein the source electrodes are connected to one another, the gate electrodes of the MOS type transistors are connected to a signal line having a prescribed potential via switching elements, and at least one input electrode is capacitively coupled with the gate electrodes; wherein circuitry is provided for applying first and second input voltages, respectively, to the input electrodes of at least one pair of first and second MOS type transistors among the plurality of MOS type transistors, and for equalizing potentials of the gate electrodes to the potential of the signal line by allowing the switching elements to conduct, and further circuitry means is provided for inputting the second and first input voltages into, respectively, the input electrodes of the first and second MOS type transistors after placing said gate electrodes in an electrically floating state by turning the switching elements off.

8 Claims, 19 Drawing Sheets

SEMICONDUCTOR ARITHMETIC CIRCUIT

BACKGROUND OF THE INVENTION

1. Field of the Invention

The present invention relates to a semiconductor arithmetic circuit, and in particular, relates to an arithmetic circuit which is capable of performing calculations on analog multi-valued data at high speed and with high accuracy.

2. Description of the Related Art.

In recent years, in concert with the development in computer technology, the progress in the field of data processing technology has been truly remarkable. However, when attempts were made to realize the flexible type of data processing conducted by human beings, it was almost impossible to obtain the results of such calculations in real time using present computers. The reasons advanced for this are that the data which human beings process in the course of their daily lives are analog data, so that there is firstly an enormous amount of such data, and moreover, these data are inexact and vague. It is thus a problem in present data processing systems that the extremely redundant analog data are all converted into digital values, and rigorous digital operations are conducted one by one.

An example of this is image processing. For example, if one screen is incorporated into a 500×500 two dimensional array, then the total number of pixels is 250, 000, and when the strength of the three colors red, green, and blue for each pixel is expressed in gterms of 8 hits, then the amount of data in one stationary image reaches 750,000 bits. In moving images, the amount of image data increases with time. Given these conditions, let us consider data processing in which the screen most resembling such an incorporated screen is selected from among a great number of screens incorporated and accumulated in the past. Even in this processing, which might at first seem to be simple, the analog vectors which comprise the screen information are used, and it is necessary to calculate the distances between analog vectors and to select that vector having the shortest distance. If an attempt is made to realize such processing by means of a computer, it is first necessary to convert all the analog vectors into digital vectors, and after this, to conduct 4-rules operations in sequence, and even if a present day super computer is used, it is impossible to manipulate the large amount of (1) and (0) data values and conduct picture recognition and understanding in real time.

On the other hand, attempts have been made to realize data processing approximating that of human beings by accepting real world data, which are analog values, in an unchanged form and conducting calculations and processing on these analog values, in order to overcome the problems described above. This approach represents the method best suited to real time processing; however, it has not yet been realized, and there exists presently no semiconductor arithmetic circuit capable of conducting such operations in real time and with high accuracy.

The present invention was created in light of the above circumstances; it has as an object thereof to provide a semiconductor arithmetic circuit which is capable of conducting calculations with respect to analog vectors at high speed and with high accuracy.

SUMMARY OF THE INVENTION

The semiconductor arithmetic circuit in the present invention having a plurality of MOS type transistors, wherein the source electrodes are connected to one another, the gate electrodes of said MOS type transistors are connected to a signal line having a prescribed potential via switching elements, and at least one inputs electrode is capacitively coupled with said gate electrodes; wherein a means is provided for applying first and second input voltages respectively applied to the input electrodes of at least one pair of first and second MOS type transistors among said plurality of MOS type transistors, and for equalizing potentials of said gate electrodes to the potential of said signal line by allowing said switching elements to conduct, and a means is provided for inputting said second and first input voltages into, respectively, the input electrodes of said first and second MOS type transistors after placing said gate electrodes in an electrically floating state by turning said switching elements off.

With the present invention, it has become possible to conduct analog vector calculations at extremely high speed and with high accuracy by providing switching elements at the gate electrodes and altering the inputs, without necessitating complicated control circuitry.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Hereinbelow, embodiments of the present invention will be discussed using the figures.

First Embodiment

Figure 1:
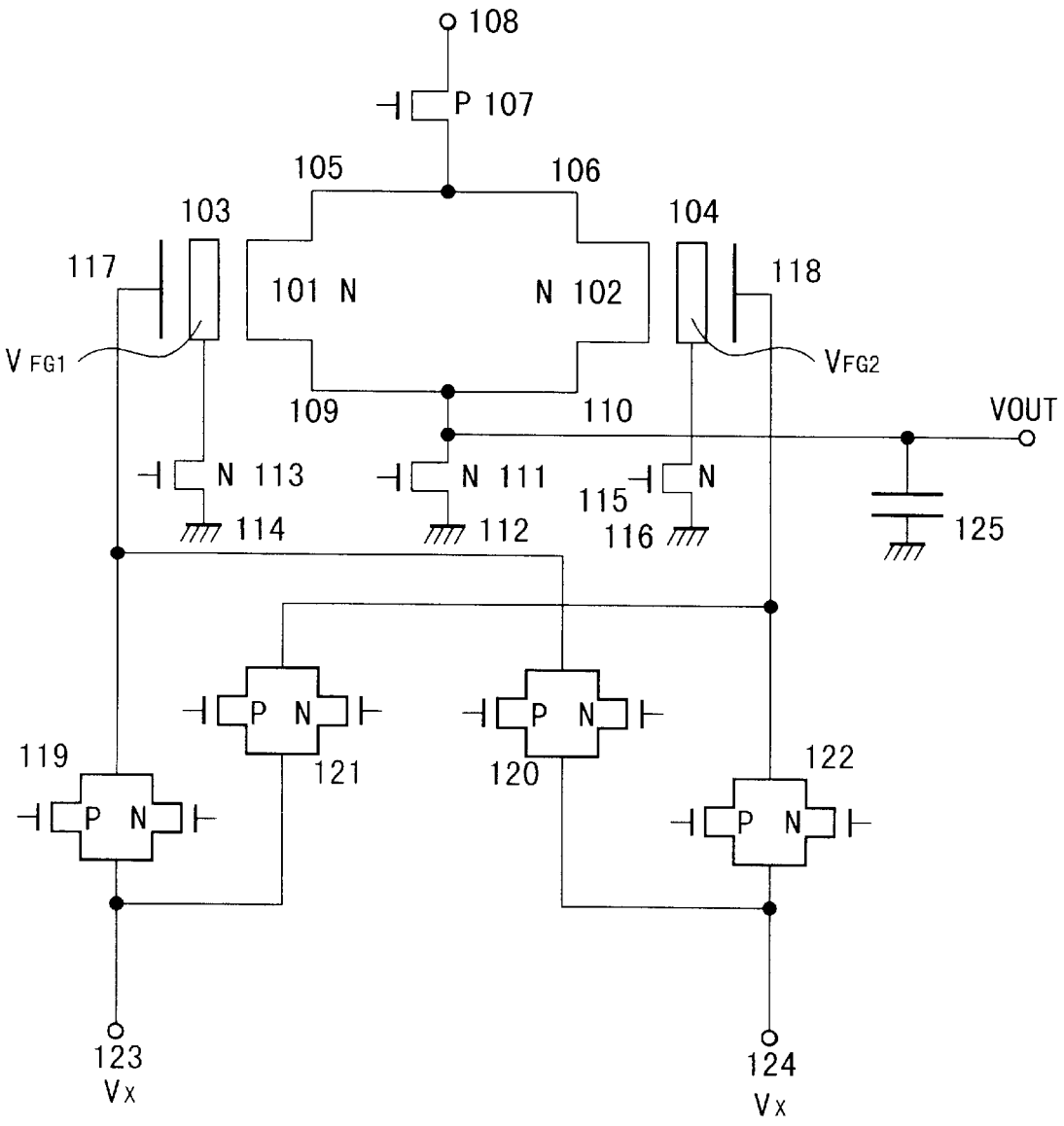
FIG. 1 is a circuit diagram relating to the first embodiment.

FIG. 1 is a circuit diagram showing a first embodiment.

References 101 and 102 indicate NMOS transistors, while references 103 and 104 indicate gate electrodes formed from, for example, $N^+$ polysilicon; gate electrode 103 controls the ON/OFF state of NMOS transistor 101, while gate electrode 104 controls that of NMOS transistor 102.

The drains 105 and 106 of NMOS 101 and 102 are connected to one another here, and PMOS switch 107 is connected via, for example, a switching element, to a 5 V signal line 108. The sources 109 and 110 of NMOS 101 and 102 are connected to one another, and NMOS 111 is connected via a switching element to a ground potential 112 of 0 V. The gate electrode 103 of NMOS 101 is connected to ground potential 114 of, here, 0 V, via, for example, NMOS 113 as a switching element, and by means of using NMOS 113 as a switching element, it is possible to equalize the potential of gate electrode 103 with a prescribed potential, and furthermore, by placing NMOS 113 in an OFF state, it is possible to place this in an electrically floating state.

The gate electrode 104 of NMOS 102 is connected to a ground potential 116 of, here, 0 V, via, for example, NMOS 115 as a switching element; by means of using NMOS 115 as a switching element, it is possible to equalize the potential of gate electrode 104 with a prescribed potential, and furthermore, by means of placing NMOS 115 in an OFF state, it is possible to place this in an electrically floating state. The gate electrode 103 of NMOS transistor 101 is capacitively coupled with input electrode 117, and the gate electrode 104 of NMOS transistor 102 is capacitively coupled with input electrode 118.

Input electrode 117 is connected with an input electrode 123 via a transmission gate 119 having, for example, a CMOS structure as a switching element, and furthermore, input electrode 117 is connected with an input electrode 124 via transmission gate 120 having, for example, an CMOS structure, as a switching element. Input electrode 118 is connected with an input electrode 123 via a transmission gate 121 having, for example, a CMOS structure, as a switching element, and input electrode 118 is further connected with an input electrode 124 via a transmission gate 122 having, for example, a CMOS structure, as a switching element. Here, transmission gates 119, 120, 121, and 122 having an CMOS structure were employed as switching elements in order to connect input electrodes 123 and 124 with input electrodes 117 and 118; however, these were only employed so that the semiconductor arithmetic circuit would be capable of accurate calculations, and there is absolutely no change in the effects of the present invention even if other switching elements are employed in place of the transmission gates 119, 120, 121, and 122 having a CMOS structure.

Furthermore, the sources 109 and 110 of NMOS transistors 101 and 102 are connected to, for example, an external capacitance load 125, and the circuit is thus such that the higher of the potential $V_{FG1}$ of gate electrode 103 and the potential $V_{FG2}$ of gate electrode 104 can be read out to the exterior as $V_{OUT}$ in the manner of a source follower circuit. Here, $V_{OUT}$ is the higher of the 2 voltages $V_{FG1}-V_{TH1}$ and $V_{FG2}-V_{TH2}$, where $V_{TH1}$ is the threshold voltage as seen from gate electrode 103 of NMOS 101, and $VTH_2$ is the threshold voltage as seen from gate electrode 104 of NMOS 102. If $V_{TH1}$ and $VTH_2$ are both set equal to, for example, 0 V, then $V_{OUT}$ will be the higher of the two voltages $V_{FG1}$ and $V_{FG2}$. Here, for the purposes of simplicity, the voltages are set such that $V_{TH1}=V_{TH2}=0$ V, but there is no change in the effects of the present invention even if a value other than 0 V is selected.

The output voltage $V_{OUT}$ is here obtained by placing the NMOS transistor 111 in an OFF state. At this time, the output voltage $V_{OUT}$ was 0 V during the ON state of NMOS transistor 111; however, as a result of placing the NMOS transistor 111 in an OFF state, this voltage begins to rise from 0 V, and continues to rise until the potential difference between the respective gate electrodes and sources of NMOS transistors 101 and 102 reach the threshold values and the NMOS transistors 101 and 102 enter an OFF state, so that, effectively, an output potential $V_{OUT}$ is outputted which has the voltage of the higher of $V_{FG1}$ and $V_{FG2}$.

Here, the drains 105 and 106 of NMOS transistors 101 and 102 are connected to one another, and are connected to a 5 V signal line 108 via PMOS transistor 107 as a switching element; however, this was set in this manner so as to prevent current flowing from the 5 V signal line 108 during the ON state of the NMOS transistor 112, and to thus reduce power consumption. Accordingly, there is no change in the effects of the present invention even if other switching elements are employed in place of PMOS transistor 107.

Furthermore, a resistor or capacitor may be employed in place of the PMOS transistor 107 which serves as a switching element, and there will be no change in the effects of the present invention even if nothing is employed and the drains 105 and 106 of NMOS transistors 101 and 102 are directly connected to the 5 V signal line 108. Furthermore, it is not necessary that the drains 105 and 106 be connected to one another, and no problem will be presented if these separately connected to the 5 V signal line 108 using methods such as those described above. Here, the drains 105 and 106 were connected to one another simply in order to facilitate circuit design.

Next, the operation of this circuit will be explained.

First, the potential ($V_A$) of input electrode 123 is inputted into the input electrode 117, which is capacitively coupled to the gate electrode 103 of NMOS transistor 101, via the transmission gate 119 having a CMOS structure, and the potential ($V_X$) of the input electrode 124 is inputted into input electrode 118, which is capacitively coupled with gate electrode 104 of the NMOS transistor 102, via transmission gate 122 having an CMOS structure. At this time, gate electrodes 103 and 104 are equalized to the ground potential, here for example 0 V, by means of allowing the NMOS transistors 113 and 115 to conduct. Then, before breaking the switching elements 119 and 122 which are currently conducting, the NMOS transistor switching elements 113 and 115 which are currently conducting are broken, and gate electrodes 103 and 104 are placed in an electrically floating state.

After this, the conducting switching elements 119 and 122 are broken, and at this time the switching elements 120 and 121 are allowed to conduct, and the potential of input electrode 123 is inputted into input electrode 118, while the potential of input electrode 124 is inputted into input electrode 117. That is to say, at the beginning, gate electrodes 103 and 104 are equalized to the ground potential, while the potentials of input electrodes 123 and 124 are inputted into, respectively, input electrodes 117 and 118.

Then, after gate electrodes 103 and 104 have been placed in an electrically floating state, the potentials of input electrodes 123 and 124 are inputted in a reversed manner from the initial state, and inputted into, respectively, input electrodes 117 and 118. Here, the potential of input electrode 123 is first inputted into input electrode 117, while the potential of input electrode 124 is inputted into input electrode 118. However, it is of course the case that absolutely no problem will be caused even if the order in which input is conducted into input electrodes 117 and 118 is opposite to the order described above. This is because the essential quality of the operation of this circuit is that when input is conducted into input electrodes 117 and 118, the input is reversed between the first input and the second input.

After the input is reversed, the potential of gate electrode 103 becomes $V_X-V_A$, while the potential of gate electrode 104 becomes $V_A-V_X$. This is the case because, since the gate electrodes 103 and 104 were in an electrically floating state prior to the switching of the inputs, when the inputs are switched, the potential of gate electrodes 103 and 104 is increased only by the difference between the potential which was first inputted and the potential which was inputted afterwards. By means of this, it is possible to obtain the difference with respect to the inputs.

With respect to the output operation, as described above, the larger of the potential of gate electrode 103 ($V_X-V_A$) and the potential of gate electrode 104 ($V_A-V_X$) is outputted as a result of placing the NMOS transistor 111 in an OFF state. By means of this, the difference between the respective inputs is obtained and it is possible to output the larger of these results, so that the maximum value is detected. The final output result $V_{OUT}$ may be represented as $|V_A-V_X|$.

Here, the potential $V_A$ of input electrode 123 will be assumed to be 4 V, while the potential $V_X$ of input electrode 124 will be assumed to be 1 V. First, the potential 4 V of input electrode 123 is inputted into input electrode 117 as a result of causing the switching element 119 to conduct, while the potential 1 V of input electrode 124 is inputted into input electrode 118 as a result of causing the switching element 122 to conduct. At this time, as a result of causing the respective NMOS transistors 113 and 115 to conduct, the gate electrodes 103 and 104 are equalized to the ground potential 0 V.

After the passage of 10 nsec, NMOS transistors 113 and 115 are broken, gate electrodes 103 and 104 are placed in an electrically floating state, and the gate electrodes 103 and 104 are thus maintained at the ground potential 0 V. Next, after the passage of 2 nsec, switching elements 119 and 122 are placed in an OFF state, and switching elements 120 and 121 are placed in an ON state, and thereby, the potential 4 V of input electrode 123 is inputted into input electrode 118, while the potential 1 V of input electrode 124 is inputted into input electrode 117.

At this time, 4 V was originally inputted, but 1 V is subsequently inputted, so that the potential of gate electrode 103 is reduced by the difference 3 V thereof, and becomes −3 V. However, in actuality, the PN junction comprising the NMOS transistor 113 has a forward bias, so that the potential only falls from 0 V by the built in potential amount, and this causes no problem in the circuitry. On the other hand, with respect to the potential of gate electrode 104, 1 V was initially inputted, while 4 V was subsequently inputted, so that the potential of gate electrode 104 is increased by the difference 3 V thereof, and becomes 3 V.

Finally, in the output operation, by placing the NMOS transistor 111 in an OFF state, and placing the PMOS transistor 107 in an ON state, NMOS transistors 101 and 102 operate as a source follower circuit, and the potential 3 V of the gate electrode 104, which maintains the larger potential of the 2 gate electrodes 103 and 104, is outputted.

Figure 2:
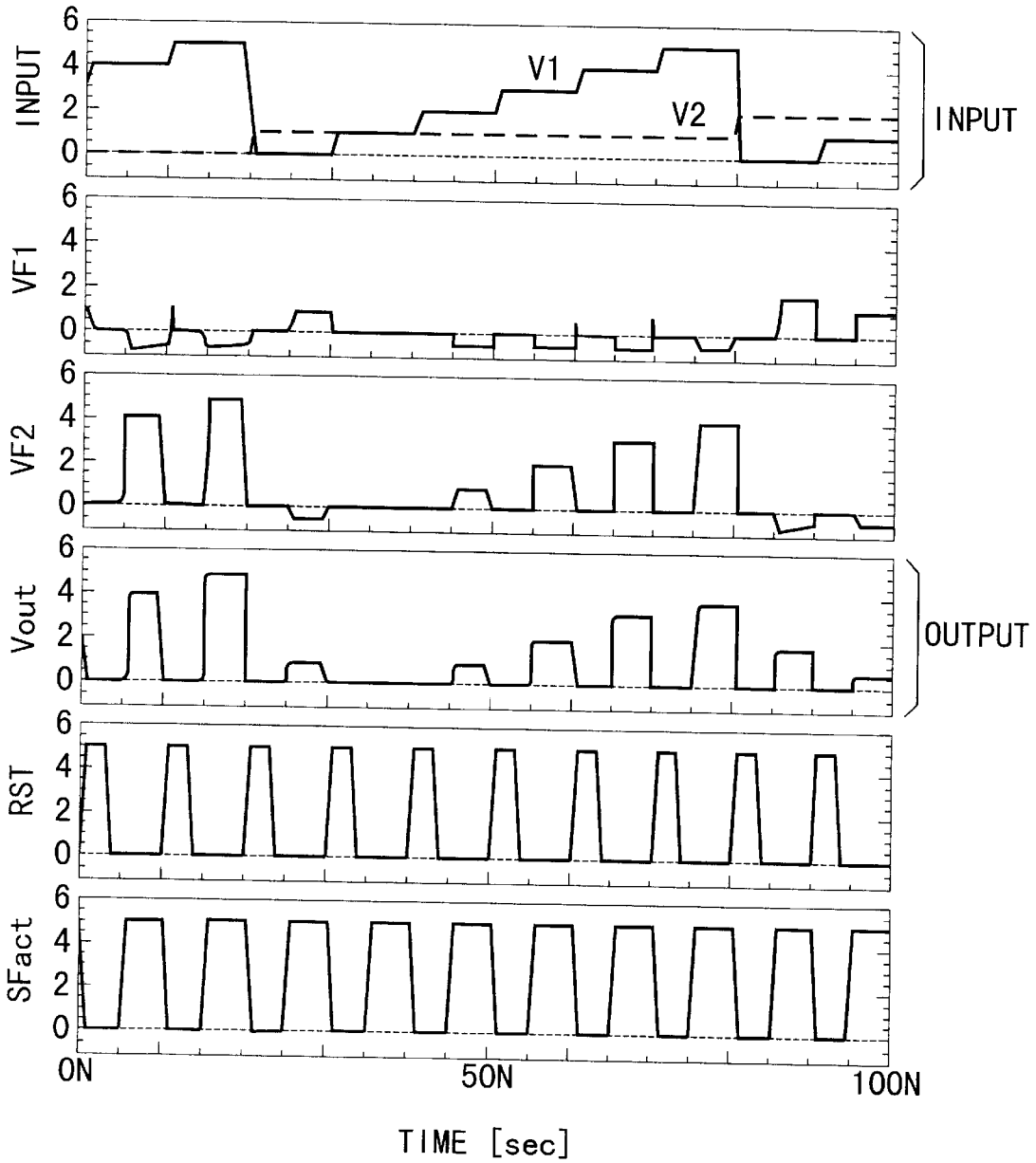
FIG. 2 shows the results of a simulation in the circuitry of the first embodiment.

In this example, a simulation was conducted using a circuit simulation (brand name: HSPICE simulation). The results thereof are shown in FIG. 2. In FIG. 2, the input voltages applied to input terminals 123 and 124 were set at 4 V and 1 V; a simulation was simultaneously conducted as an example with respect to the other cases as well. It can be seen clearly from FIG. 2 that the operation was correct in all examples.

In this concrete example, the potential of input electrode 123 was set at 4 V, while the potential of input electrode 124 was set at 1 V; however, it is of course the case that calculations may be conducted on freely selected analog values.

Here, NMOS transistors 111, 113, and 115 were used as switching elements; however, no problems will caused if other switching elements, such as PMOS transistors, transmission gates having a CMOS structure, or the like, are used in place of these transistors. Furthermore, with respect to NMOS transistor 111, this was used here as a switching element; however, no problem will be caused if a resistor, a capacitor, or a current source or the like is used in place of this switching element. Furthermore, the ground potential 112 was set to 0 V in order to facilitate circuit design; however, there will be no changes to the effects of the present invention even if a voltage other than 0 V is used as the ground potential.

As described above, in the circuit of the present invention, by switching the inputs and by attaching switching elements 113 and 115 to gate electrodes 103 and 104 and equalizing gate electrodes 103 and 104 with the ground potential and placing these electrodes in an electrically floating state, it is possible to obtain the difference between the inputted data, and furthermore, as a result of obtaining this difference, it is possible to select the largest value, so that a circuit is realized which calculates the absolute value of the difference between inputted data in real time and with high accuracy.

Presently, in order to conduct data processing in which the difference between inputted data expressed in analog values is obtained and only the largest value is selected, it is first necessary to conduct A/D conversion of the analog data, and after this, an extremely large number of four-rules calculations must be conducted by means of a computer, so that it is impossible to obtain results in real time. However, if this semiconductor arithmetic circuit which has been invented is employed, such calculations can be realized using simple circuitry such as that shown in FIG. 1, and moreover, it is possible to conduct such calculations at high speed. Accordingly, the present invention is extremely important in that it permits the realization of calculations which were heretofore impossible.

Second Embodiment

Figure 3:
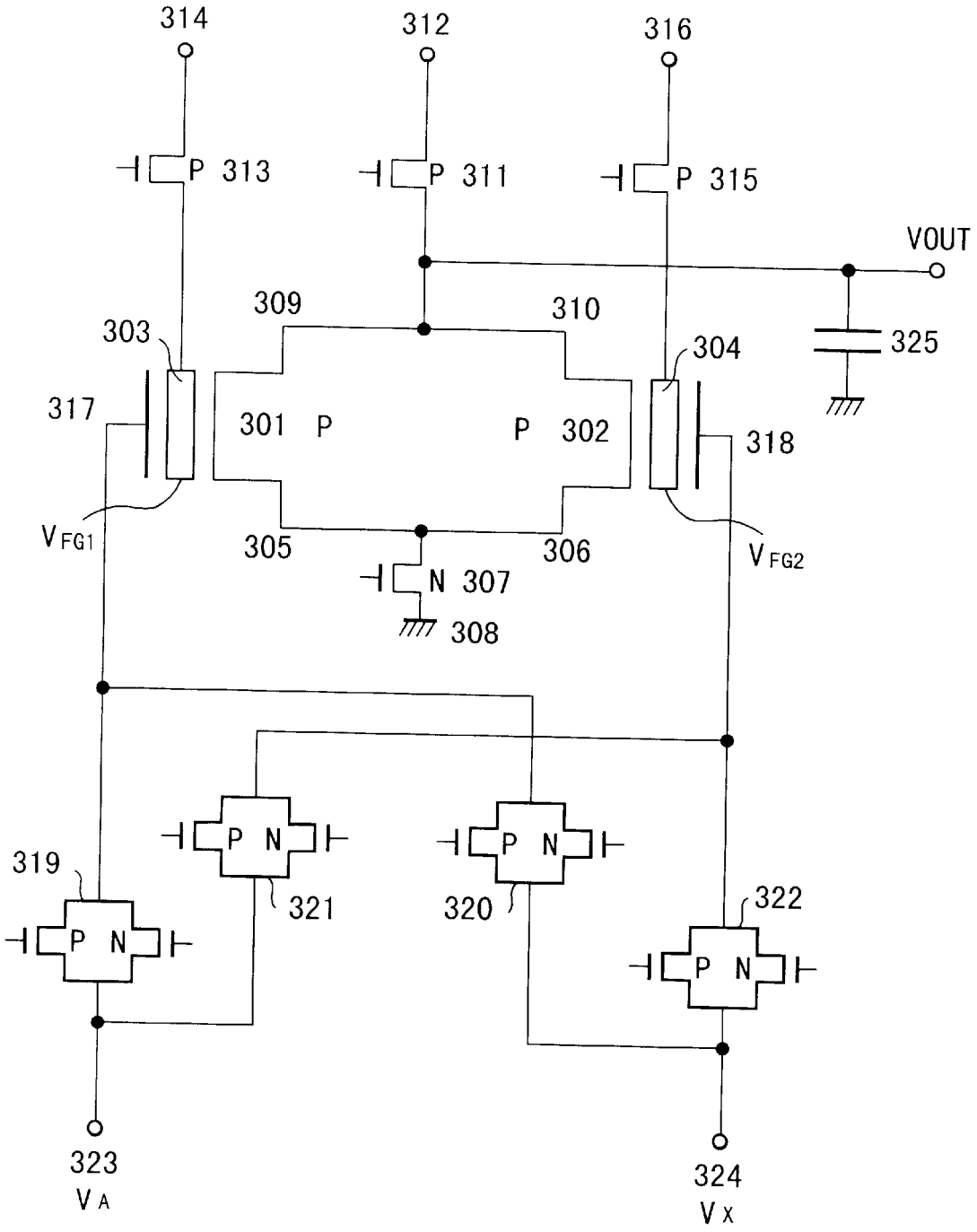
FIG. 3 is a circuit diagram relating to the second embodiment.

FIG. 3 is a circuit diagram showing a second embodiment.

References 301 and 302 indicate PMOS transistors, while references 303 and 304 indicate gate electrodes formed from, for example, $N^+$ polysilicon; gate electrode 303 controls the ON/OFF state of PMOS transistor 301, while gate electrode 304 controls that of PMOS transistor 302. The drains 305 and 306 of PMOS 301 and 302 are connected to one another, and these are connected to a 0 V ground potential 308 via, for example, NMOS transistor 307 as a switching element.

On the other hand, the sources 309 and 310 of PMOS transistors 301 and 302 are connected to one another, and these are connected to 5 V signal line 312 via a PMOS transistor 311 as a switching element. The gate electrode 303 of PMOS transistor 301 is connected here to a 5 V signal line via, for example, PMOS 313 as a switching element; by means of using PMOS 313 as a switching element, it is possible to equalize gate electrode 303 to a prescribed potential, and by means of placing PMOS 313 into a OFF state, it is possible to place gate electrode 303 in an electrically floating state.

The gate electrode 304 of PMOS transistor 302 is connected here to a 5 V signal line via, for example, PMOS 315 as a switching element; by means of using PMOS 315 as a switching element, it is possible to equalize the gate electrode 304 to a prescribed potential, and furthermore, by means of placing PMOS 315 in an OFF state, it is possible to place gate electrode 304 in an electrically floating state.

Input electrode 317 is capacitively coupled to gate electrode 303 of PMOS transistor 301, and input electrode 313 is capacitively coupled to gate electrode 304 of PMOS transistor 302. Input electrode 317 is connected to input electrode 323 with transmission gate 319 having a CMOS structure as a switching element, and furthermore, input electrode 317 is connected to input electrode 324 with, for example, a transmission gate 320 having a CMOS structure as a switching element. Input electrode 317 is connected to input electrode 323 with, for example, a transmission gate 321 having a CMOS structure as a switching element, and furthermore, input electrode 318 is connected to input electrode 324 with, for example, a transmission gate 322 having a CMOS structure as a switching element.

Here, the transmission gates 319, 320, 321, and 322 having a CMOS structure were employed as switching elements in order to connect input electrodes 323 and 324 with input electrodes 317 and 318; however, this was only done so that the semiconductor arithmetic circuit would be capable of carrying out accurate calculations, and there are no changes in the effects of the present invention even if other switching elements are used in place of the transmission gates 319, 320, 321, and 322 having a CMOS structure. Furthermore, the sources 309 and 310 of PMOS transistors 301 and 302 are connected, for example, to an external capacitance load 325, and the circuit has a structure such that the lower of the potentials VFG1 of gate electrode 303 and $V_{FG2}$ of gate electrode 304 can be read out to the exterior as $V_{OUT}$ in the manner of a source follower circuit.

Here, $V_{OUT}$ is the lower of the voltages $V_{FG1}-V_{TH1}$ and $V_{FG2}-V_{TH2}$; $V_{TH1}$ is the threshold voltage as viewed from gate electrode 303 of PMOS transistor 301, while $V_{TH2}$ is the threshold voltage as viewed from gate electrode 304 of PMOS transistor 302. For example, if the setting is such that $V_{TH1}=V_{TH2}=0$ V, then $V_{OUT}$ is the lower of the two voltages VFG1 and $V_{FG2}$. Here, for the purposes of simplicity, the setting is such that $V_{TH1}=V_{TH2}=0$ V, but there is no change in the effects of the present invention if a value other than 0 V is used.

The output voltage $V_{OUT}$ is obtained by placing PMOS transistor 311 in an OFF state. At this time, the output voltage $V_{OUT}$ was 5 V when PMOS transistor 311 was in the ON state; however, when the PMCS transistor 311 enters the OFF state, this potential begins to decrease from 5 V, and this potential continues to decline until the potential difference between the respective gate electrodes and respective sources of PMOS transistors 301 and 302 reach their threshold values and both the PMOS transistors 301 and 302 enter an OFF state, so that effectively, the lower of the voltages $V_{FG1}$ and $V_{FG2}$ is outputted as output potential $V_{OUT}$.

Here, the drains 305 and 306 of PMOS transistors 301 and 302 are connected to one another, and these are connected to the 0 V ground potential 308 via NMOS transistor 307 as a switching element; however, this was set in this manner in order to prevent a current flowing from the 5 V signal line 312 to the ground potential 308 when PMOS transistor 311 is in an ON state, thus reducing power consumption.

Accordingly, there is no change in the effects of the present invention even if other switching elements such as an PMOS transistor or transmission gate having an CMOS structure or the like are employed in place of the NMOS transistor 307. Furthermore, a resistor, a capacitor, or a current source may be employed in place of the NMOS transistor 307 switching element, and there will be no change in the effects of the present invention even if nothing is used and the drains 305 and 306 of PMOS transistors 301 and 302 are directly connected to the 0 V ground potential 308. Furthermore, it is not necessary that the drains 305 and 306 be connected to one another; no problems will be caused even if these are connected separately to the 0 V ground potential 308 using the methods described above. Here, the drains 305 and 306 were connected to one another solely in order to facilitate the circuit design.

Next, the operation of this circuit will be explained.

First, the potential of the input electrode 323 ($V_A$) is initially inputted into the input electrode 317, which is capacitively coupled with the gate electrode 303 of PMOS transistor 301, via the transmission gate 319 having a CMOS structure. Along with this, the potential of input electrode 324 ($V_X$) is inputted into input electrode 318, which is capacitively coupled with gate electrode 304 of PMOS transistor 302, via transmission gate 322 having a CMOS structure. At this time, gate electrodes 303 and 304 are equalized with the potential ($V_{DD}$) of the 5 V signal line 308 by allowing the NMOS transistors 313 and 314 to conduct. Next, prior to breaking the switching elements 319 and 322 which are currently conducting, the currently conducting PMOS transistor switching elements 313 and 315 are broken, and gate electrodes 303 and 304 are placed in an electrically floating state.

After this, the conducting switching elements 319 and 322 are broken, and switching elements 320 and 321 are caused to conduct, so that the potential of input electrode 323 is inputted into input electrode 318, while the potential of input electrode 324 is inputted into input electrode 317. That is to say, the gate electrodes 303 and 304 are initially equalized to the potential ($V_{DD}$) of the signal line 308, and the potentials of input electrodes 323 and 324 are inputted into, respectively, input electrode 317 and 318, and subsequently, after gate electrodes 303 and 304 have been placed in an electrically floating state, the potentials of input electrodes 323 and 324 are inputted in a reversed manner from the initial state, and are inputted into, respectively, input electrodes 317 and 318.

Here, the potential of input electrode 323 is first inputted into input electrode 317, while the potential of input electrode 324 is inputted into input electrode 318. However, it is of course the case that no problems will be caused even if the order of input into input electrodes 317 and 318 is opposite to that described above. This is because the essential feature of the operation of this circuit is that during input into input electrodes 317 and 318, input is conducted in a reversed manner between the first and second stages. After the input has been switched, the potential of gate electrode 303 becomes $V_{DD}+V_X-V_A$, while the potential of gate electrode 304 becomes $V_{DD}+V_A-V_X$. The reason for this is that because the gate electrodes 303 and 304 were in an electrically floating state prior to the switching of the inputs, when the inputs are switched, the potential of gate electrodes 303 and 304 is increased from $V_{DD}$ by the difference between the potential which was initially inputted and the potential which was subsequently inputted. By means of this, the difference between the inputs is obtained and the results are subtracted from $V_{DD}$.

With regard to the output operation, as described above, by placing PMOS transistor 311 in an OFF state, the smaller of the potentials of gate electrode 303 ($V_{DD}+V_X-V_A$) and gate electrode 304 ($V_{DD}+V_A V_X$) is outputted. By means of this, after the difference is obtained with respect to the inputs, this is taken from $V_{DD}$, and it is possible to output the smallest value among the results, so that the smallest value may be detected. The final output result $V_{OUT}$ may be expressed as $|V_{DD}-(V_A-V_X)|$.

Here, the potential $V_A$ of input electrode 323 will be assumed to be 4 V, while the potential $V_X$ of input electrode 324 will be assumed to be 1 V.

First, the potential 4 V of input electrode 323 is inputted into input electrode 317 by causing switching element 319 to conduct, and the potential 1 V of input electrode 324 is inputted into input electrode 318 by causing switching element 322 to conduct. At this time, gate electrodes 303 and 304 are equalized with the potential ($V_{DD}$) of the 5 V signal line 312 by causing PMOS transistors 313 and 315, respectively, to conduct.

After the passage of 10 nsec, the PMOS transistors 313 and 315 are broken, and gate electrodes 303 and 304 are placed in an electrically floating state, so that gate electrodes 303 and 304 are maintained at the potential $V_{DD}$ of the signal line 312. Then, after the passage of 2 nsec, switching elements 319 and 322 are placed in an OFF state, and switching elements 320 and 321 are placed in an ON state, and thereby, the potential 4 V of input electrode 323 is inputted into input electrode 318, while the potential 1 V of input. electrode 324 is inputted into input electrode 317. At this time, with respect to the potential of gate electrode 303, 4 V was initially inputted, and 1 V was subsequently inputted, so that the potential of gate electrode 303 is reduced by the difference therebetween, 3 V, resulting in 5 V−3 V=2 V.

With respect to the potential of gate electrode 304, 1 V was initially inputted, while 4 V was subsequently inputted, and thereby, the potential of gate electrode 304 is increased by the difference therebetween, 3 V, so that the result is 5 V+3 V=8 V. However, in actuality, the PN junction comprising the PMOS transistor 315 has a forward bias, so that the potential increases from 5 V only by the amount of the built-in potential, and this poses no problems in the circuitry.

Finally, in the output operation, PMOS transistor 311 is placed in an OFF state, and NNOS transistor 307 is placed in an ON state, and thereby PMOS 301 and 302 function as a source follower circuit, and the potential 2 V of the gate electrode 304, which maintains the larger potential among the gate electrodes 303 and 304, is outputted.

Figure 4:
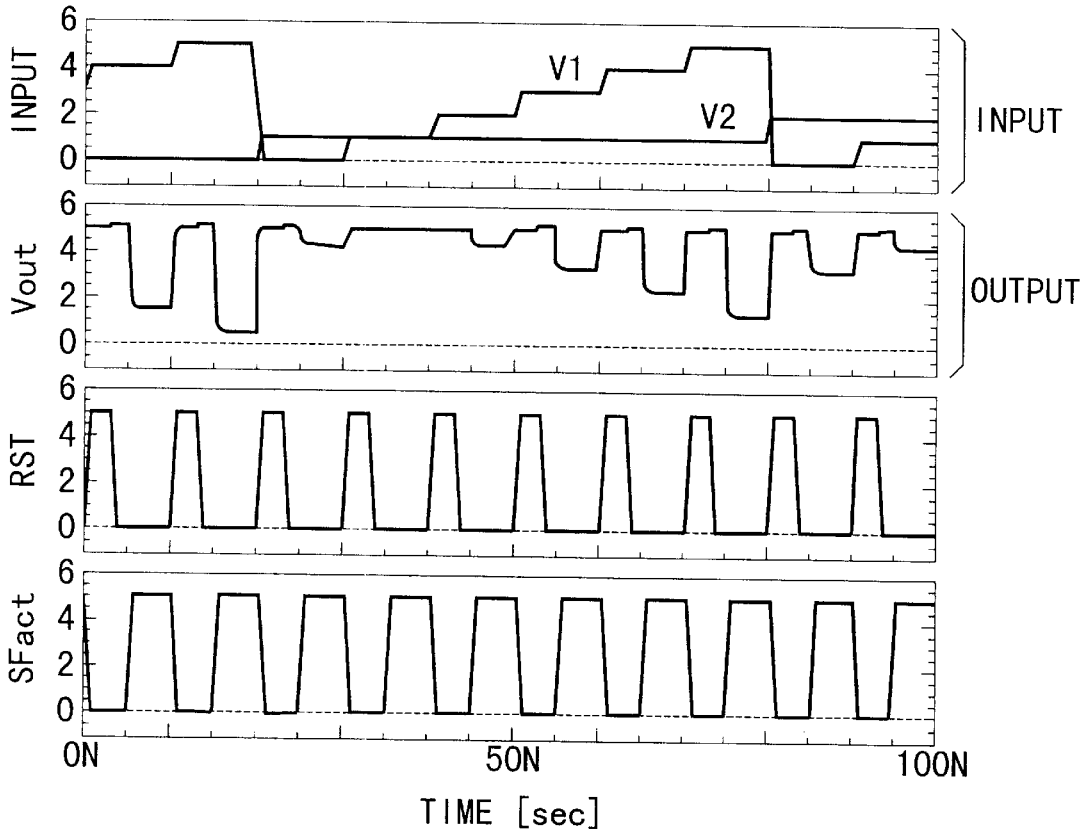
FIG. 4 shows the results of a simulation in the circuitry of the second embodiment.

With respect to this example, a simulation was conducted using the HSPICE simulation, and the results thereof are shown in FIG. 4. In FIG. 4, the input voltages applied to input electrodes 323 and 324 were set at 4 V and 1 V; with respect to the other cases, as well, a simulation was simultaneously conducted as an example. It can be clearly seen from FIG. 4 that the operation was correct with respect to all examples.

Here, as a concrete example, the potential of input electrode 323 was set to 4 V, while the potential of input electrode 324 was set to 1 V; however, it is of course the case that calculation may be conducted with respect to freely selected analog values.

Here, PMOS transistors 311, 313, and 315 were employed as switching elements; however, no problems will be caused even if other switching elements, such as NMOS transistors, transmission gates having a CMOS structure, or the like, are employed in place of these transistors. Furthermore, with respect to the PMOS transistor 311, this was employed here as a switching element; however, no problems will be caused if a resistor, capacitor, or the like is used in place of this switching element. Furthermore, the potential of signal line 312 was set at 5 V ($V_{DD}$) in order to facilitate circuit design; however, the effects of the present invention will not change even if a voltage other than 5 V ($V_{DD}$) is employed as the potential of signal line 312.

As described above, in the circuit of the present invention, by means of reversing the inputs and by means of attaching switching elements 313 and 315 to gate electrodes 303 and 304 and equalizing gate electrodes 303 and 304 to the ground potential and placing them in an electrically floating state, the difference between inputted data is obtained, this is subtracted from a certain voltage, and it is possible to select the smallest value among the results, so that ultimately, a circuit is realized which is capable of expressing the degree of agreement of inputted data in terms of a score, in real time and with a high degree of accuracy.

Presently, in order to conduct data processing in which the difference is obtained between inputted data expressed as analog values and the results thereof are expressed in terms of a score, it is first necessary to subject the analog data to A/D conversion, and then to conduct an enormous number of 4-rules calculations using a computer, so that it is impossible to obtain a result in real time. However, if the semiconductor arithmetic circuit of this invention is employed, it is possible to realize such calculations using simple circuitry such as that shown in FIG. 3, and moreover, it is possible to conduct calculations at high speed. Accordingly, the present invention is extremely important in that it makes possible the realization of calculations which were heretofore impossible to realize.

Third Embodiment

Figure 5:
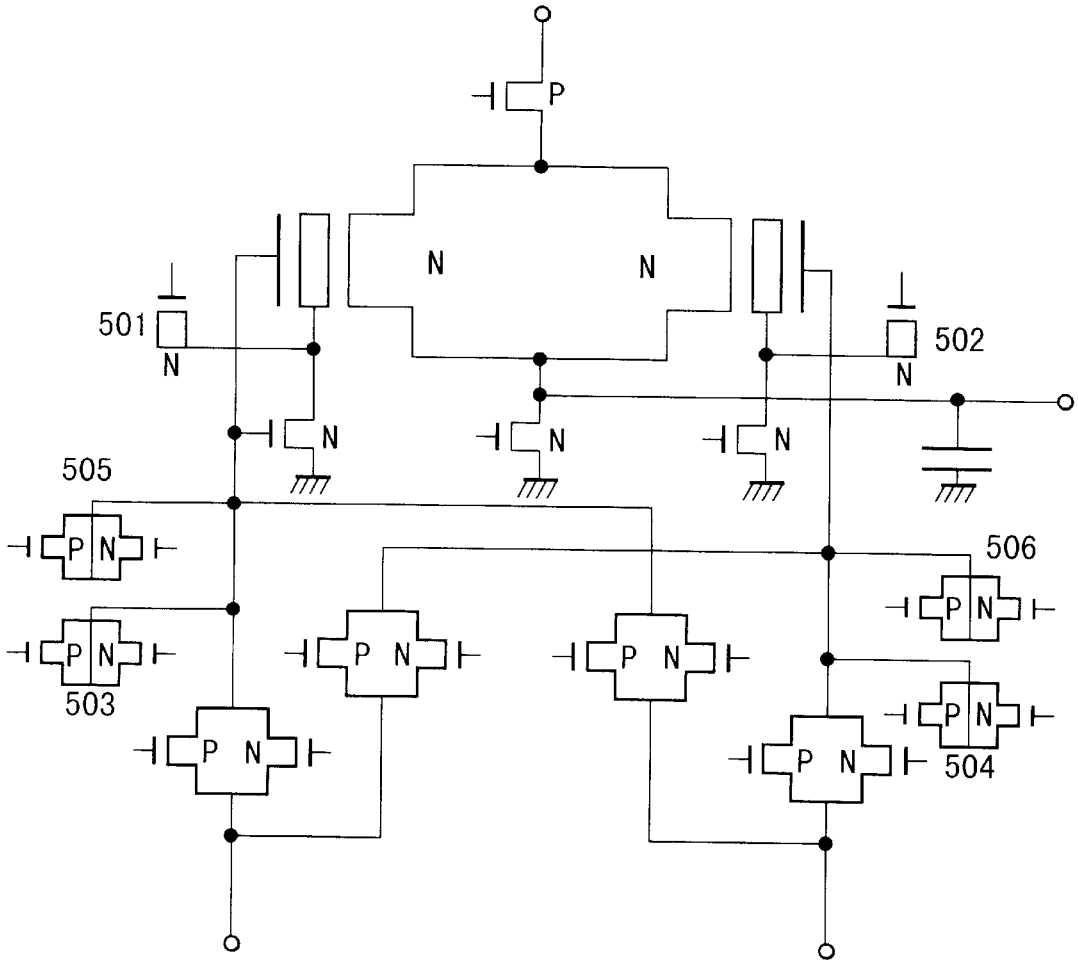
FIG. 5 is a circuit diagram relating to the third embodiment.

FIG. 5 is a circuit diagram showing a third embodiment of the present invention. This embodiment has almost the same structure as the first embodiment. Accordingly, only the structure and operational principles of those portions which are changed will be explained.

Charge cancel transistor 501 is an NMOS transistor, and the source and drain thereof are directly connected to one another. Charge cancel transistor 501 is also connected to the gate electrode 103 of NMOS transistor 101. The gate width of this charge cancel transistor 501 is set, for example, so as to be half the gate width of NMOS transistor 113, and furthermore, these transistors are designed so as to be completely identical with respect to all other conditions.

With respect to the operation, when NMOS transistor 113 is in an ON state, charge cancel transistor 501 is in an OFF state, and when NMOS transistor 113 is in an OFF state, charge cancel transistor 501 is in an ON state. That is to say, the structure is such that the ON and OFF states are opposite to one another.

Furthermore, charge cancel transistor 502 is a NMOS transistor, and the source and drain thereof are directly connected to one another. Charge cancel transistor 502 is also connected to gate electrode 104 of NMOS transistor 102. The gate width of this charge cancel transistor 502 is designed to be, for example, half the gate width of the NMOS transistor 115.

With respect to the operation, when NMOS transistor 115 is in an ON state, charge cancel transistor 502 is in an OFF state, and when NMOS transistor 115 is in an OFF state, charge cancel transistor 502 is in an ON state. That is to say, the structure is such that the ON and OFF states are opposed to one another.

Charge cancel transistor 503 is a transition gate having a CMOS structure in which both the sources and drains of a NMOS and a PMOS are connected to one another; this charge cancel transistor 503 is connected to input electrode 117. With respect to this charge cancel transistor 503, the gate width of the PMOS and NNOS is designed so as be half the gate width of the PMOS and NMOS of the transmission gate 119 having an CMOS structure, but these transistors are designed so as to be completely identical with respect to all other conditions.

With respect to the operation, when the transmission gate 119 having a CMOS structure is in an ON state, the charge cancel transistor 503 is in an OFF state, while when the transmission gate 119 having a CMOS structure is in an OFF state, the charge cancel transistor 503 is in an ON state. That is to say, the ON and OFF states of charge cancel transistor 503 and the transmission gate 119 having a CMOS structure are opposite to one another.

Charge cancel transistor 504 is a transmission gate having a CMOS structure in which both the sources and drains of a NMOS and a PMOS are connected to one another; this charge cancel transistor 504 is connected to an input electrode 118. With respect to this charge cancel transistor 504, the gate width of the PMOS and NMOS thereof is designed to be half the gate width of the PMOS and NMOS of the transmission gate 122 having a CMOS structure, and furthermore, these transistors are designed so as to be completely identical with respect to all other conditions.

With respect to the operation, when the transmission gate 122 having a CMOS structure is in an ON state, the charge cancel transistor 504 is in an OFF state, and when the transmission gate 122 having a CMOS structure is an OFF state, then the charge cancel transistor 504 is in an ON state. That is to say, the ON and OFF states of the charge cancel transistor 504 and the transmission gate 122 having a CMOS structure are opposite to one another.

Charge cancel transistor 505 is a transmission gate having a CMOS structure in which both the sources and the drains of a NMOS and a PMOS are connected to one another; this charge cancel transistor 505 is connected to an input electrode 117. With respect to this charge cancel transistor 505, the gate width of the PMOS and NMOS thereof is designed so as to be half the gate width of the PMOS and NMOS of the transmission gate 120 having a CMOS structure, and furthermore, these transistors are designed so as to be completely identical with respect to all other conditions.

With respect to the operation, when the transmission gate 120 having a CMOS structure is in an ON state, the charge cancel transistor 505 is in an OFF state, and when the transmission gate 120 having a CMOS structure is an OFF state, then the charge cancel transistor 505 is in an ON state. That is to say, the ON and OFF state of the charge cancel transistor 505 and the transmission gate 120 having a CMOS structure are opposite to one another.

Charge cancel transistor 506 is a transmission gate having a CMOS structure in which both the sources and the drains of a NMOS and a PMOS are connected to one another; this charge cancel transistor 506 is connected to input electrode 118. With respect to this charge cancel transistor 506, the gate width of the PMOS and NMOS thereof is designed so as to be half the gate width of the PMOS and NMOS of the transmission gate 121 having a CMOS structure, and furthermore, these transistors are designed so as to be completely identical with respect to all other conditions.

With respect to the operation, when the transmission gate 121 having a CMOS structure is in an ON state, then the charge cancel transistor 506 is in an OFF state, and when the transmission gate 121 having a CMOS structure in an OFF state, the charge cancel transistor 506 is in an ON state. That is to say, the ON and OFF state of the charge cancel transistor 506 and the transmission gate 121 having a CMOS structure are opposite to one another.

The reason that the charge cancel transistors 501, 502, 503, 504, 505, and 506 are connected as shown in FIG. 5 is that problems are caused when the switching elements 111, 113, 115, 119, 120, 121, and 122 are realized using PMOS, NMOS, and the like. When transistors are used as switches, the voltage signal applied to the gate electrodes of the transistors determines the ON and OFF state of the transistors. By changing the voltage signal within a range of 0 V to 5 V, it can be determined whether the transistors are in an ON state or OFF state.

The problem is that when the signals applied to the gate electrodes are switched, for example, with respect to the case of NMOS, when the change is from 5 V to 0 V and the transistor changes from ON to an OFF state, a portion of the charge built up in the channel of the NMOS transistor flows out to both electrodes connected to the switch, and this causes the potential on the output side to fluctuate in an undesirable manner, although only slightly. When the potential on the output side fluctuates, this leads to errors in calculation results, and there is some danger that accurate operations will become impossible. Here, what is meant by the potential on the output side is that of gate electrodes 103 and 104 and input electrodes 117 and 118.

With respect to a method for solving this problem, with regard to the clock voltage applied to the switching elements within the circuit, if for example, the time in which the clock voltage changes from 5 V to 0 V is sufficiently long, almost no problems are caused; however, as attempts are made to increase the operating speed of the circuitry as a whole, the time in which the clock voltage changes is necessarily shortened. As the time for the change is shortened, the effects of the charge appearing from the channel of the transistor on the output side become increasingly large. Accordingly, the speed can not be increased beyond a certain point. This problem is termed clock feed through; presently it is said with respect to this problem that the amount of charge appearing on the output side is exactly half the size of the charge built up in the channel of the switch transistor, in general.

Accordingly, if transistors in which the gate width is halved and the source and the drain are connected to one another are installed at the output side, and these transistors are given a ON and OFF state timing which is opposite to that of the switch transistors, then when the switch transistors enter an OFF state, the charge appearing in the output side may be absorbed in the process in which the charge cancel transistor enters an ON state in the channel thereof, and furthermore, when the switch transistors enter an ON state, the charge appearing in the process in which the charge cancel transistor enters an OFF state from the channel thereof can be absorbed by the channel of the switch transistors, so that the clock feed through problem can be solved.

Accordingly, it is possible to conduct analog calculations with a higher degree of accuracy. Here, the gate width of the charge cancel transistors was set at half the gate width of the switching element transistors to which they respectively correspond; however, the amount of charge appearing on the output side as a result of the time required for the change in voltage of the clock voltage may deviate slightly from the amount of charge which is currently generally said to appear, so that it is not necessarily the case that the gate width must be halved, and the gate width may be different in certain cases. Accordingly, the gate width of the charge cancel transistor is not necessarily limited to half, and may have a size in correspondence with the switching elements.

Fourth Embodiment

Figure 6:
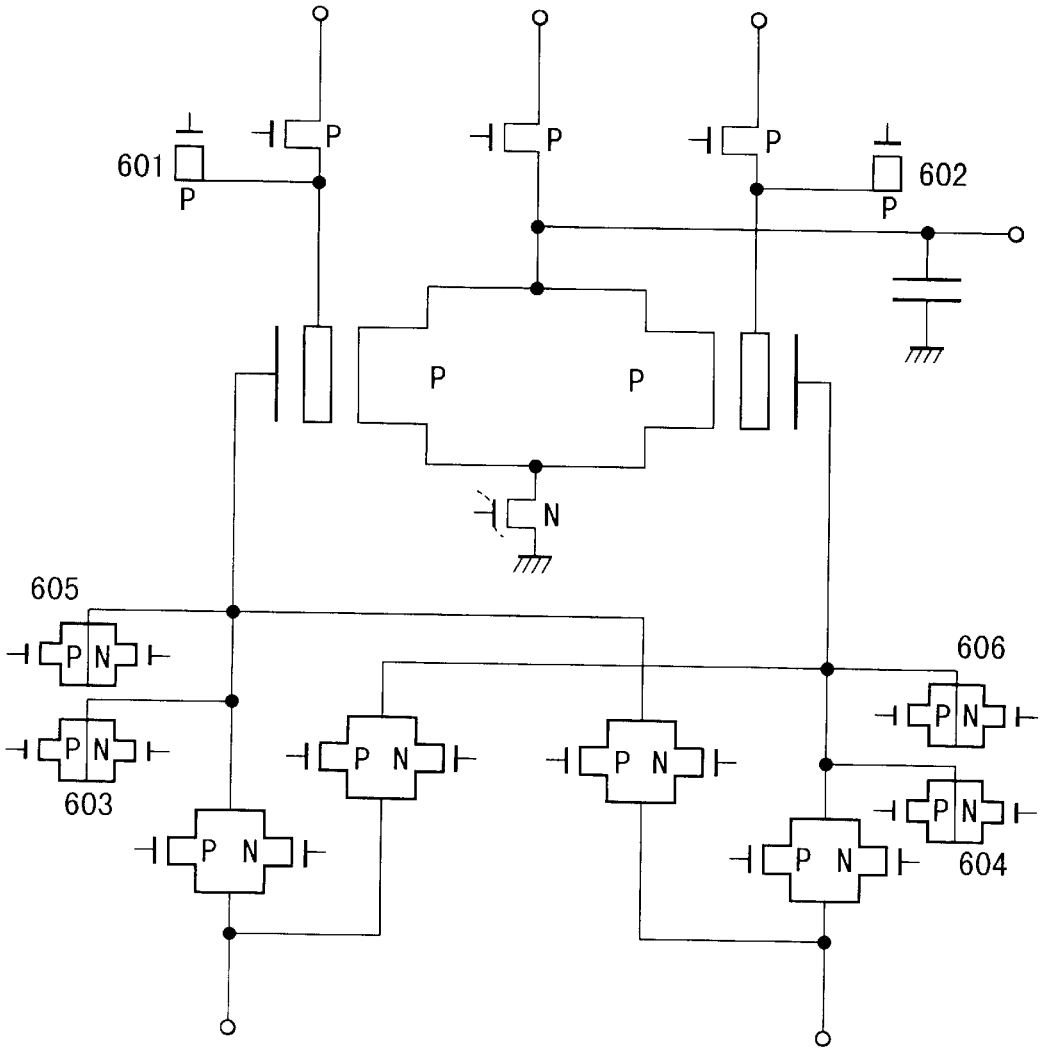
FIG. 6 is a circuit diagram relating to the fourth embodiment.

FIG. 6 shows a fourth embodiment. This embodiment has a structure which is almost identical to that of the second embodiment. Accordingly, only an explanation of the structure and operational principle of those portions which are changed will be given here.

Charge cancel transistor 601 is, here, a PMOS transistor, and the source and drain thereof are connected to one another. Charge cancel transistor 601 is also connected to gate electrode 203 of PMOS transistor 201. The gate width of the charge cancel transistor 601 is designed, for example, so as to be half the gate width of PMOS transistor 213, and these transistors are designed so as to be completely identical with respect to all other conditions.

With regard to the operation, when PMOS transistor 213 is in an ON state, charge cancel transistor 601 is in an OFF state, and when PMOS transistor 213 is in OFF state, charge cancel transistor 601 is in an ON state. That is to say, the ON and OFF states thereof are opposite to one another.

Furthermore, charge cancel transistor 602 is a PMOS transistor, and the source and drain thereof are directly connected to one another. Charge cancel transistor 602 is also connected to gate electrode 204 of PMOS transistor 202. The gate width of this charge cancel transistor 602 is designed so as to be, for example, half the gate width of PMOS transistor 215.

With regard to the operation, when PMOS transistor 215 is in an ON state, charge cancel transistor 602 is in an OFF state, and when PMOS transistor 115 is in an OFF state, charge cancel transistor 602 is in an ON state. That is to say, the ON and OFF states thereof are opposite to one another.

Charge cancel transistor 603 is a transmission gate having a CMOS structure in which the sources and drains of a NMOS and PMOS are connected to one another; this charge cancel transistor 603 is connected to input electrode 217. With respect to this charge cancel transistor 603, the gate widths of the PMOS and NMOS are designed so as to be half the gate width of the PMOS and NMOS of the transmission gate 219 having a CMOS structure, and furthermore, these transistors are designed to be completely identical with respect to all other conditions.

With regard to the operation, when transmission gate 219 having a CMOS structure is in an ON state, charge cancel transistor 603 is in an OFF state, and when the transmission gate 219 having CMOS structure is in an OFF state, charge cancel transistor 603 is in an ON state. That is to say, the ON and OFF states of charge cancel transistor 603 and the transmission gate 219 having a CMOS structure are opposite to one another.

Charge cancel transistor 604 is a transmission gate having a CMOS structure in which the sources and drains of a NMOS and PMOS are connected to one another; this charge cancel transistor 604 is also connected to an input electrode 218. With respect to this charge cancel transistor 604, the gate widths of the PMOS and NMOS thereof are designed so as to be half the gate widths of the PMOS and NMOS of the transmission gate 222 having a CMOS structure, and furthermore, these transistors are designed so as to be completely identical with respect to all other conditions.

With respect to the operation, when the transmission gate 222 having a CMOS structure is in an ON state, charge cancel transistor 604 is in an OFF state, and when transmission gate 222 having a CMOS structure is in an OFF state, charge cancel transistor 604 is in an ON state. That is to say, the ON and OFF states of charge cancel transistor 604 and the transmission gate 222 having a CMOS structure are opposite to one another.

Charge cancel transistor 605 is a transmission gate having a CMOS structure in which the sources and drains of a NMOS and PMOS are connected to one another; this charge cancel transistor 605 is also connected to input electrode 217. With respect to this charge cancel transistor 605, the gate widths of the PMOS and NMOS are designed so as to be half the gate width of the PMOS and NMOS of the transmission gate 220 having a CMOS structure, and furthermore, these transistors are designed so as to be completely identical with respect to all other conditions.

With regard to the operation, when the transmission gate 220 having a CMOS structure is in an ON state, the charge cancel transistor 605 is in an OFF state, and when the transmission gate 220 having a CMOS structure is in an OFF state, the charge cancel transistor 605 is in an ON state. That is to say, the ON and OFF states of the charge cancel transistor 605 and the transmission gate 220 having a CMOS structure are opposite to one another.

Charge cancel transistor 606 is a transmission gate having a CMOS structure in which the sources and drains of a NMOS and PMOS are connected to one another; this charge cancel transistor 606 is also connected to input electrode 218. With respect to this charge cancel transistor 606, the gate widths of the PMOS and NMOS are designed so as to he half the gate widths of the PHOS and NMOS of the transmission gate 221 having a CMOS structure, and furthermore, these transistors are designed so as to be completely identical with respect to all other conditions.

With respect to the operation, when the transmission gate 221 having a CMOS structure is in an ON state, charge cancel transistor 606 is in an OFF state, and when the transmission gate 221 having CMOS is in an OFF state, the charge cancel transistor 606 is in an ON state. That is to say, the ON and OFF states of the charge cancel transistor 606 and the transmission gate 221 having a CMOS structure are opposite to one another.

The reason that charge cancel transistors 601, 602, 603, 604, 605, and 606 are connected as shown in FIG. 5 is because of the problems caused when the switching elements 211, 213, 215, 219, 220, 221, and 222 are realized using PMOS and NMOS. When transistors are used as switches, the ON and OFF states thereof are determined by the voltage signal applied to the gate electrodes of the transistors. Whether a transistor is in an ON state or OFF state is determined by changing the voltage signal from 0 V to 5 V.

The problem is that when a signal applied to the gate electrodes is switched, for example, in the case of a PMOS, when the signal is switched from 5 V in the direction of 0 V and the transistor moves from an ON state to an OFF state, a portion of the charge built up in the channel of the PMOS transistor flows out in an undesirable manner to both electrodes connected to the switch, and the potential on the output side fluctuates in an undesirable manner, albeit only slightly. When the potential on the output side fluctuates, this can lead to errors in calculations, and there is some danger that it will become impossible to conduct accurate calculations. What is meant by the potential on the output side is that of gate electrodes 203 and 204 and input electrodes 217 and 218.

With respect to a method for solving these problems, with regard to the clock voltage applied to the switching elements in the circuit, if the time required for the clock voltage to change from, for example, 5 V to 0 V is sufficiently long, there will be no problem; however, as attempts are made to increase the operational speed of the circuitry as a whole, this can not be accomplished without reducing the time in which the clock voltage changes. As the time for the change becomes short, the effect of the charge appearing in the channel of the transistor on the output side becomes increasingly large. Accordingly, it is impossible to increase the speed beyond a certain point.

This problem is termed clock feed through; it is said with respect to this problem that the amount of charge appearing on the output side is presently precisely half of the charge built up in the channel of the switch transistor, in general. Accordingly, if transistors in which the gate width is halved and the source and the drain are connected to one another are installed on the output side, and these are given a ON and OFF state timing opposite to that of the switch transistors, then the charge appearing in the output side just when the switch transistor enters an OFF state can be absorbed in the process in which the charge cancel transistor enters an ON state in the channel thereof, and furthermore, the charge appearing in the process in which the charge cancel transistor enters an OFF state from the channel thereof when the switch transistor enters an ON state can be absorbed by the channel of the switch transistor, so that it is possible to solve the clock feed through problem. Accordingly, it becomes possible to conduct analog calculations with a high degree of accuracy. Here, the gate width of the charge cancel transistors was set so as to be half the gate width of the switching element transistors to which they respectively corresponded; however, the amount of charge appearing in the output side as a result of the time required for the voltage change in the clock voltage may differ slightly from the amount of charge which is generally said to appear, so that it is not the case that the gate width must be half, and this width may be different in certain cases. Accordingly, the gate width of the charge cancel transistors is not necessarily limited to being exactly half, and has a size in correspondence with the switching elements.

Fifth Embodiment

Figure 7:
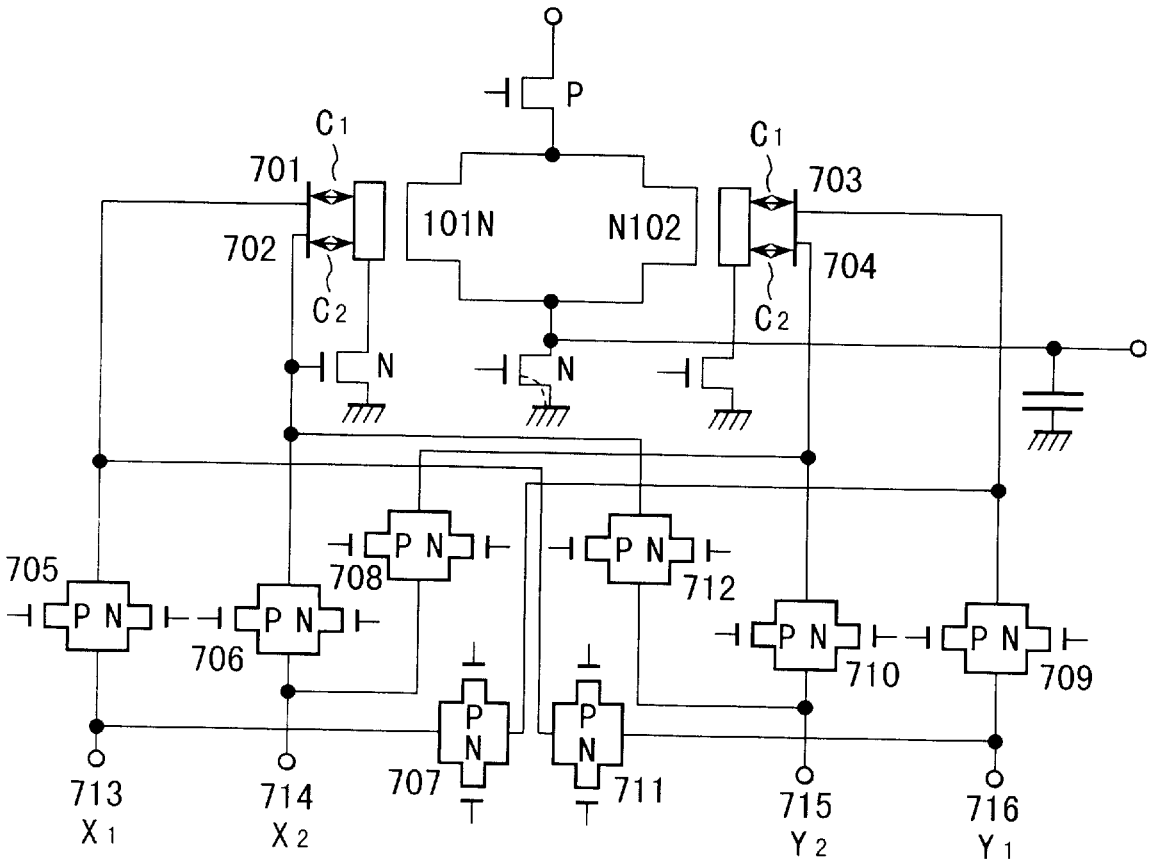
FIG. 7 is a circuit diagram relating to the fifth embodiment.

FIG. 7 is a circuit diagram showing a fifth embodiment. This embodiment has a structure which is almost identical to that of the first embodiment. In the first embodiment, there were two input electrodes, 117 and 118, but in this embodiment, four such electrodes were employed. The basic operation is identical to that of the first embodiment, so that only the structure and operational principle of the portions which are changed will be explained.

Here, input electrode 701 is capacitively coupled with gate electrode 103 of NMOS transistor 101 via a capacitance $C_1$, and furthermore, input electrode 702 is capacitively coupled via a capacitance $C_2$. In the same manner, input electrode 703 is capacitively coupled with gate electrode 104 of NMOS transistor 102 via a capacitance $C_1$, while input electrode 704 is capacitively coupled via a capacitance $C_2$.

Here, input electrode 713 (potential $X_1$) is connected with input electrodes 701 and 703 via respectively, transmission gates 705 and 707 having a CMOS structure as switching elements. Input electrode 714 (potential $X_2$) is connected with input electrodes 702 and 704 with, respectively, transmission gates 706 and 708 having a CMOS structure as switching elements. Input electrode 716 (potential $Y_1$) is connected with input electrodes 703 and 701 with, respectively, transmission gates 709 and 711 having an CMOS structure as switching elements. Input electrode 715 (potential $Y_2$) is connected with input electrodes 704 and 702 with, respectively, transmission gates 710 and 712 having a CMOS structure as switching elements.

The operation proceeds in the same manner as embodiment 1; first, gate electrodes 103 and 104 are initially set to the ground potential, and then transmission gates 705, 706, 709, and 710 having a CMOS structure are placed in an ON state, and the potentials $X_1$, $X_2$, $Y_1$ and $Y_2$ of input electrodes 713, 714, 715, and 716 are inputted into, respectively, input electrodes 701, 702, 703, and 704. Subsequently, after gate electrodes 103 and 104 have been placed in an electrically floating state, the transmission gates 705, 706, 709), and 710 having a CMOS structure are placed in an OFF state, and then transmission gates 707, 708, 711, and 712 having a CMOS structure are placed in an ON state, and the potentials $X_1$, $X_2$, $Y_1$ and $Y_2$ of input electrodes 713, 714, 715, and 716 are inputted into, respectively, input electrodes 703, 704, 701, and 702. At this time, the potentials of gate electrodes 103 and 104 are as follows: $\{(C_1Y_1+C_2Y_2)-(C_1X_1+C_2X_2)\}/C_{TOT}$, and $\{(C_1X_1+C_2X_2)-(C_1Y_1+C_2Y2)\}/C_{TOT}$, respectively ($C_{TOT}=C_1+C_2+C_0$, where $C_0$ is the gate capacitance of NMOS 101 and 102).

Finally, in the output operation, the larger of the potentials of gate electrodes 103 and 104 is reduced by the amount of the threshold values of NMOS transistors 101 and 102, and is outputted. Here, the threshold values of NMOS transistors 101 and 102 were set: to 0 V, so that the larger of the potentials of gate electrodes 103 and 104 is outputted in an unchanged manner.

By means of this, it is possible to obtain the mutual difference among a plurality of inputs, which was heretofore not realizable, and it is thus possible to realize a high degree of analog calculations in which the largest value is outputted.

Here, two input electrodes were capacitively coupled to gate electrodes 103 and 104; however, it is of course the case that the number of input electrodes which are capacitively coupled is not necessarily so restricted. Furthermore, with respect to the switching elements, it is not necessary to restrict these elements to those identical to those used in the first embodiment; insofar as the circuit operates correctly, any sort of elements may be employed. Furthermore, it is of course the case that no problems will be caused if charge cancel transistors are employed with respect to the switching elements as was described in the third embodiment.

Sixth Embodiment

Figure 8:
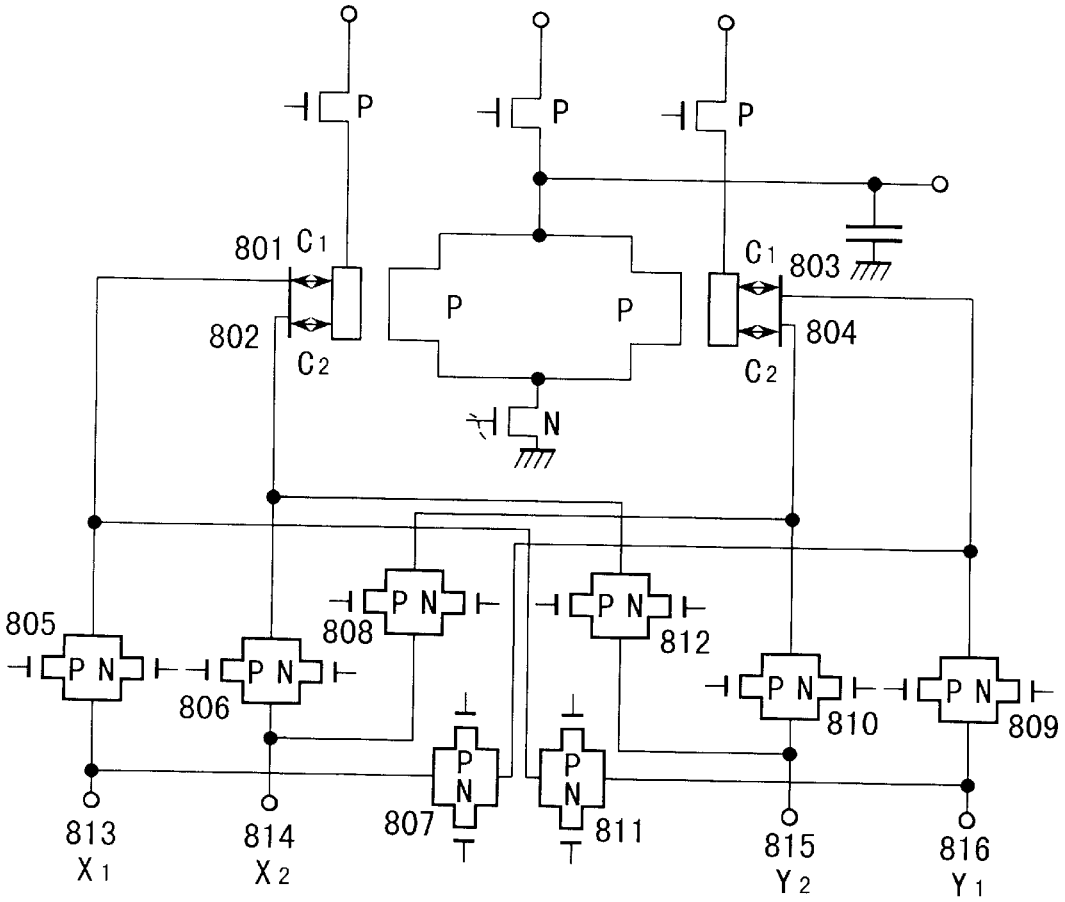
FIG. 8 is a circuit diagram relating to the sixth embodiment.

FIG. 8 is a circuit diagram showing a sixth embodiment. This embodiment has a structure which is almost identical to that of the second embodiment. In the second embodiment, two input electrodes 217 and 218 were employed; however, here, four such electrodes are employed. The basic operation is identical to that of the first embodiment, so that only the structure and operational principle of those portions which are changed will be discussed.

Here, input electrode 801 is capacitively coupled with gate electrode 203 of PMOS transistor 201 via a capacitance $C_1$, while input electrode 802 is capacitively coupled via a capacitance $C_2$. In the same manner, input electrode 803 is capacitively coupled with gate electrode 204 of PMOS transistor 202 via a capacitance $C_1$, while input electrode 804 is capacitively coupled via a capacitance $C_2$.

Here, input electrode 813 (potential $X_1$) is connected to input electrodes 801 and 803 with, respectively, transmission gates 805 and 807 having a CMOS structure as switching elements. Input electrode 814 (potential $X_2$) is connected to input electrodes 802 and 804 with, respectively, transmission gates 806 and 808 having a CMOS structure as switching elements. Input electrode 816 (potential $Y_1$) is connected to input electrodes 803 and 801 with, respectively, transmission gates 809 and 811 having a CMOS structure as switching elements. Input electrode 815 (potential $Y_2$) is connected to input electrodes 304 and 802 with, respectively, transmission gates 810 and 812 having a CMOS structure as switching elements.

The operation proceeds in the same manner as in the second embodiment; first, gate electrodes 203 and 204 are initially set to the ground potential, and then the transmission gates 805, 806, 809, and 810 having a CMOS structure are placed in an ON state, and the potentials $X_1$, $X_2$, $Y_1$, and $Y_2$ of input electrodes 813, 814, 815, and 816 are inputted into, respectively, input electrodes 801, 802, 803, and 804. Subsequently, after gate electrodes 203 and 204 have been placed in an electrically floating state, the transmission gates 805, 806, 809, and 810 having a CMOS structure are placed in an OFF state, and then CMOS transmission gates 807, 808, 811, and 812 are placed in an ON state, and the potentials $X_1$, $X_2$, $Y_1$,and $Y_2$ of input electrodes 813, 814, 815, and 816 are inputted into, respectively, input electrodes 803, 804, 801, and 802. At this time, the potentials of gate electrodes 203 and 204 are: $\{V_{DD}+(C_1Y_1+C_2Y_2)-(C_1X_1+C_2X_2)\}/C_{TOT}$, and $\{V_{DD}+(C_1X_1+C_2X_2)-(C_1Y_1+C_2Y_2)\}/C_{TOT}$, respectively ($C_{TOT}=C_1+C_2+Co$, where Co is the gate capacitance of PMOS 201 and 202).

Finally, in the output operation, the larger of the potentials of gate electrodes 203 and 204 is reduced by the amount of the threshold value of PMOS transistors 201 and 202, and is outputted. Here, the threshold values of PMOS transistors 201 and 202 are set to 0 V, so that the larger of the potentials of gate electrodes 203 and 204 is outputted in an unchanged manner.

By means of this, it is possible to realize a high degree of analog calculations in which the difference between a plurality of inputs is obtained, and the largest value thereof is outputted, which was heretofore unrealizable.

Here, two input electrodes were capacitively coupled to gate electrodes 203 and 204; however, it is of course the case that the number of input electrodes which are capacitively coupled in this manner is not necessarily so restricted. Furthermore, with respect to the various elements, as well, it is not necessary to restrict the switching to those employed in the second embodiment; insofar as the operation is correct, it is of course the case that any type of element may be employed. Furthermore, it is of course the case that no problems will caused if charge cancel transistors are employed with respect to the various switching elements, as described in the fourth embodiment above.

Seventh Embodiment

Figure 9:
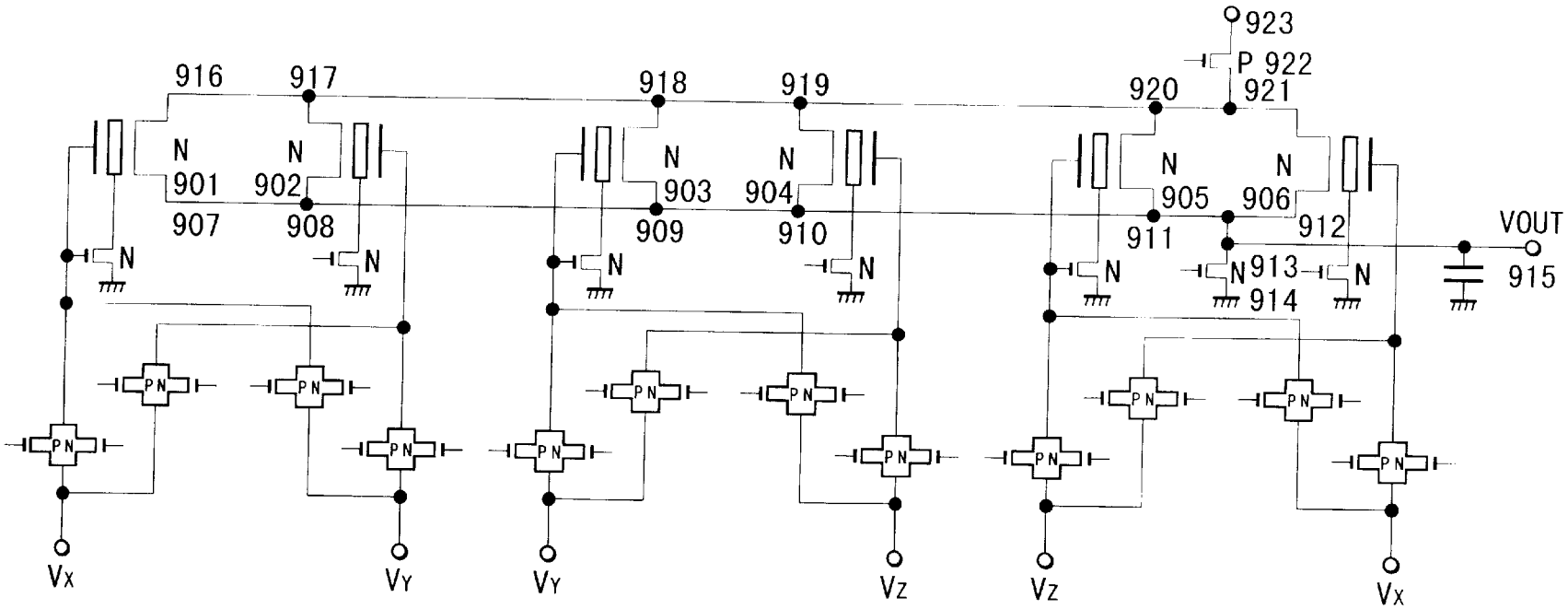
FIG. 9 is a circuit diagram relating to the seventh embodiment.

FIG. 9 is a circuit diagram showing a seventh embodiment. In this embodiment, a plurality of the circuits described in the first embodiment (difference absolute value circuits) are arranged and the source electrodes of the various NMOS transistors are connected to one another. This circuit is employed when the number of inputted data is 3. As is clear from the first embodiment, when the number of inputted data is 2, 2 NMOS transistors are necessary to determine the difference. Accordingly, when the number of inputted data is 3 or more, all sets of 2 data are selected from among the 3 data and the absolute value of the difference therebetween is determined with respect to these data, so that the circuit is realized using 3 difference absolute value circuits, since the calculation is such that $3C_2=6$.

In this circuit, the source electrodes 907, 908, 909, 910, 911, and 912 of the NMOS transistors 901, 902, 903, 904, 905, and 906 are all connected to one another, and NMOS transistor 913 is connected to the ground potential 914 as a switching element. Furthermore, the drain electrodes 916, 917, 918, 919, 920, and 921 of the NMOS transistors 901, 902, 903, 904, 905, and 906 are connected to one another, and the PMOS transistor 922 is connected to the power source line 923 as a switching element. By connecting source electrodes 907, 908, 909, 910, 911, and 912 to, for example, an external capacitance load 915, it is possible to read out the results of the calculations in the circuit to the exterior as the output.

If the input data are $V_X$, $V_Y$, and $V_Z$, then the circuit operation is such that from the 3 inputted data, pairs of 2 data are constructed: ($V_X$, $V_Y$), ($V_Y$, $V_Z$), and ($V_Z$, $V_X$). The concrete operational principle of the circuitry with respect to the various pair is identical to the operational principle described in the first embodiment, so that a description thereof will be omitted here. In this embodiment, the largest value among the results of the calculations on the pairs in the circuitry, $|V_X-V_Y|$, $|V_Y-V_Z|$, and $|V_Z-V_X|$, is outputted.

Furthermore, the number of circuits required depends on the number of inputted data; if the number of inputted data is N, and the circuit described in the first embodiment is one circuit, then the number of circuits required may be calculated using the formula $NC_2/2$.

By means of this, it is possible to handle a number of data such that this number is greater than 2, and it is possible to select the two most similar data from among a large number of data at high speed and with a high degree of accuracy.

Here, the difference absolute value circuit described in the first embodiment was employed as the individual circuit; however, it is of course the case that no problems will be caused even if the circuits described in the third embodiment or fifth embodiment are employed.

Eighth Embodiment

Figure 10:
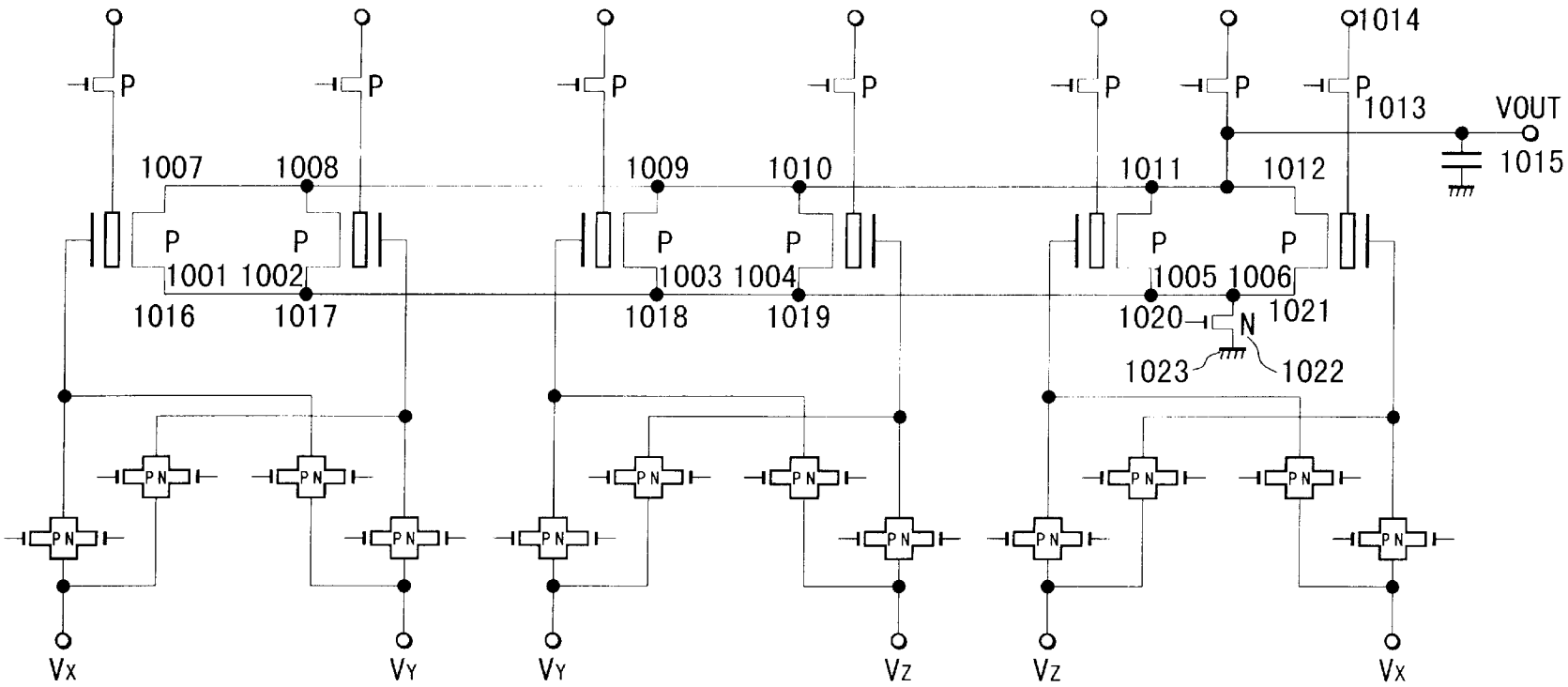
FIG. 10 is a circuit diagram relating to the eighth embodiment.

FIG. 10 is a circuit diagram showing an eighth embodiment. In this embodiment, a plurality of the circuits described in the second embodiment (difference absolute value circuits) are arranged, and the source electrodes of the various PMOS transistors are connected to one another. This circuit is employed when the number of inputted data is 3. As is clear from the second embodiment, when the number of inputted data is 2, 2 PMOS transistors are necessary to determine the difference. Accordingly, when the number of inputted data is 3 or more, all groups of 2 data are selected from the 3 data and the absolute value of the difference thereof is calculated, so that it is possible to realize this circuit using 3 difference absolute value circuits, since the calculation is $3C_2=6$.

In this circuit, the source electrodes 1007, 1008, 1009, 1010, 1011, and 1012 of the PMOS transistors 1001, 1002, 1003, 1004, 1005, and 1006 are all connected to one another, and PMOS transistor 1013 is connected to the power source line 1014 as a switching element. Furthermore, the drain electrodes 1016, 1017, 1018, 1019, 1020, and 1021 of PMOS transistors 1001, 1002, 1003, 1004, 1005, and 1006 are all connected to one another and NMOS transistor 1022 is connected to the ground Potential 1023 as a switching element. By connecting source electrodes 1007, 1008, 1009, 1010, 1011, and 1012 to, for example, an external capacitance load 1015, it is possible to read out the results of the calculation of the circuit to the exterior as the output thereof. The circuit operation is such if the inputted data a $V_X$, $V_Y$, and $V_Z$, then groups of 2 data are selected from the 3 data: ($V_X$, $V_Y$), ($V_Y$, $V_Z$), and ($V_Z$, $V_X$). The basic operational principle of the circuitry with respect to these various groups is identical to the operational principles discussed in the second embodiment, so that a description thereof will be omitted here. In this embodiment, the minimum value among the results of the calculation in this circuit on the various pairs, $|V_{DD}+(V_X-V_Y)|$, $|V_{DD}+(V_Y-V_2)|$, and $|V_{DD}+(V_Z-V_X)|$, is outputted.

Furthermore, the number of circuits required is determined by the number of inputted data, and if the number of inputted data is represented by N and the circuit described in the first embodiment is used as one circuit, then the number required is given by the formula $NC_2/2$.

By means of this, it is possible to handle a number of data larger than 2, and it is possible to select the 2 data which are most similar from a large number of data at high speed and with a high degree of accuracy.

Here, the difference absolute value circuits described in the second embodiment were employed as the individual circuits; however, it is of course the case that no problems will be caused even if the circuits described in the fourth or sixth embodiments are employed.

Ninth Embodiment

Figure 11:
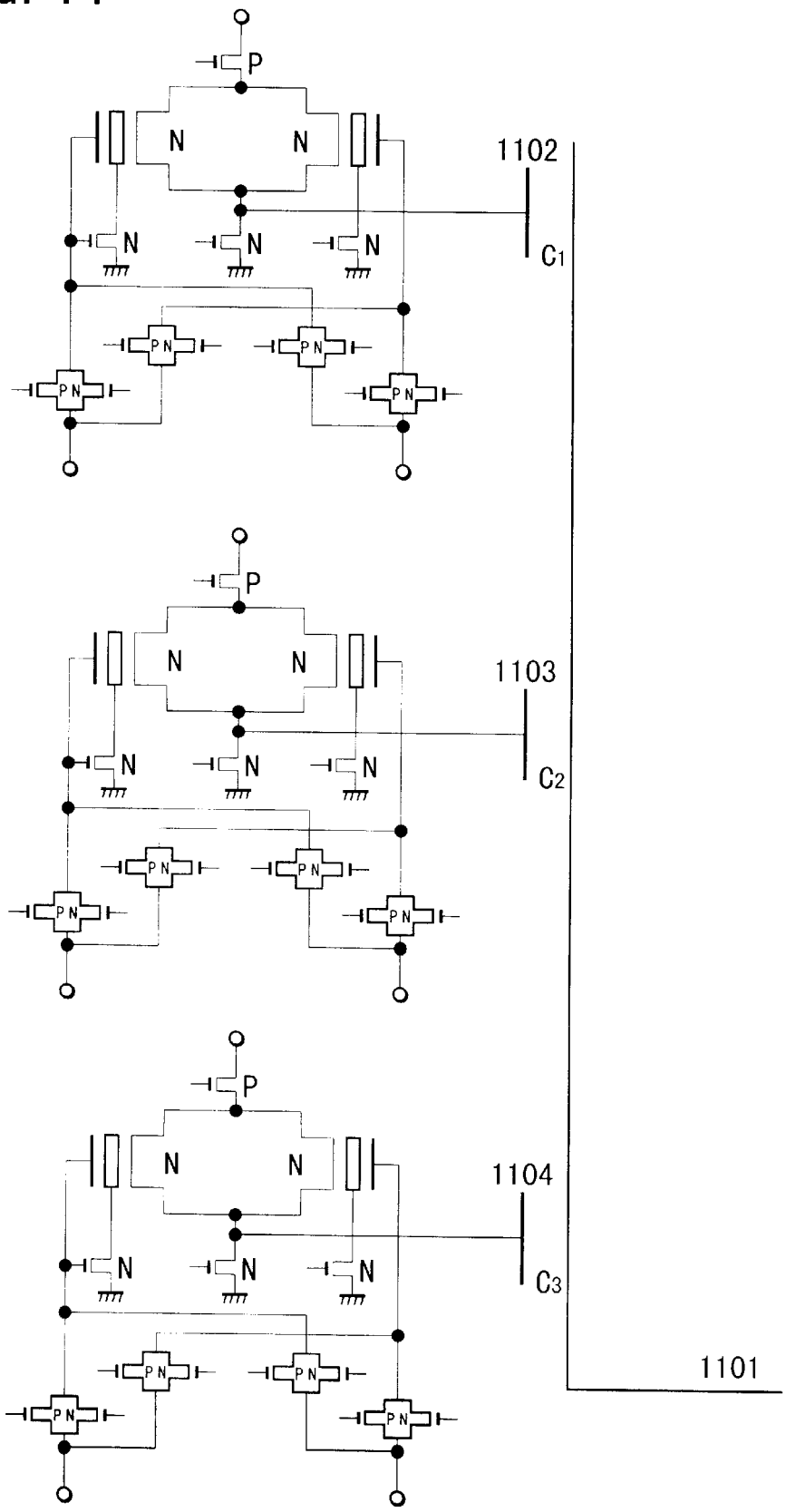
FIG. 11 is a circuit diagram relating to the ninth embodiment.

FIG. 11 is a circuit diagram showing a ninth embodiment. In this embodiment, a plurality of the circuits shown in the first embodiment are arranged, and the outputs thereof are capacitively coupled with electrode 1101. By means of this, it is possible to average the results calculated by the various circuits.

The circuit structure in this embodiment will now be described. A plurality of the circuits shown in the first embodiment (difference absolute value circuits) are arranged. The various output electrodes 1102, 1103, and 1104 of the difference absolute value circuits are capacitively coupled with electrode 1101 via capacities $C_1$, $C_2$, and $C_3$. Here, these capacities $C_1$, $C_2$, and $C_3$ are all equal.

In this embodiment, the operation of the various individual difference absolute value circuits is identical to the operation of the circuit described in the first embodiment above, so that a description thereof will be omitted here.

By means of this, it is possible to calculate how closely the various groups of 2 data resemble one another, and it is also possible to average the results of these calculations, so that it is possible to compress data expressed as analog values at high speed and with high accuracy.

Here, the difference absolute value circuits described in the first embodiment were used as the combinations of individual circuits; however, it is of course the case that no problems will be caused even if the circuitry described in the third embodiment, fifth embodiment, or seventh embodiment is employed, insofar as the purposes of the circuitry are distinguished.

Tenth Embodiment

Figure 12:
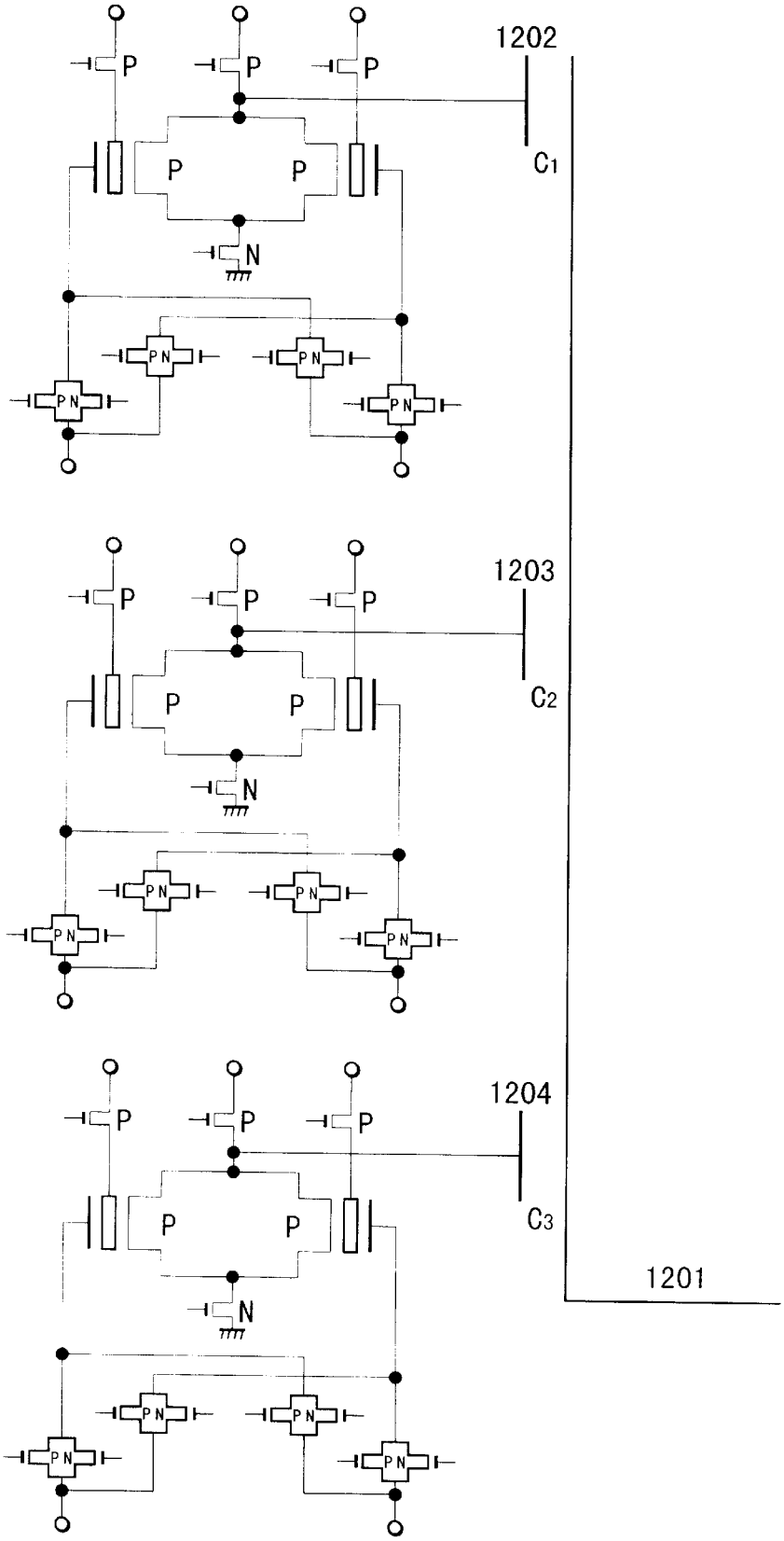
FIG. 12 is a circuit diagram relating to the tenth embodiment.

FIG. 12 is a circuit diagram showing a tenth embodiment. In this embodiment, a plurality of the circuits shown in the second embodiment are arranged, and the outputs thereof are capacitively coupled to electrode 1201. By means of this, it is possible to average the results of the calculations performed by the circuits.

The circuit structure in the present embodiment will now be explained. A plurality of the circuits described in the second embodiment (difference absolute value circuits) are arranged. The outputs 1202, 1203, and 1204 of the individual difference absolute value circuits are capacitively coupled with electrode 1201 via capacities $C_1$, $C_2$, and $C_3$. These capacities $C_1$, $C_2$, and $C_3$ are set here so as to be equal.

In this embodiment, the operation of the individual difference absolute value circuits is identical to the operation of the circuits described in the first embodiment, so that a description thereof will be omitted here.

By means of this, it is possible to calculate to what extent the various pairs of 2 data resemble one another, and it is possible to average the results of these calculations, so that it is possible to compress data expressed as analog values at high speed and with a high degree of accuracy.

Here, the difference absolute value circuits described in the first embodiment were employed as the combinations of individual circuits; however, it is of course the case that no problems will be caused if other individual circuits, such as the circuits described in the fourth, sixth, and eighth embodiments, are used, insofar as the purposes thereof are distinguished.

Eleventh Embodiment

Figure 13:
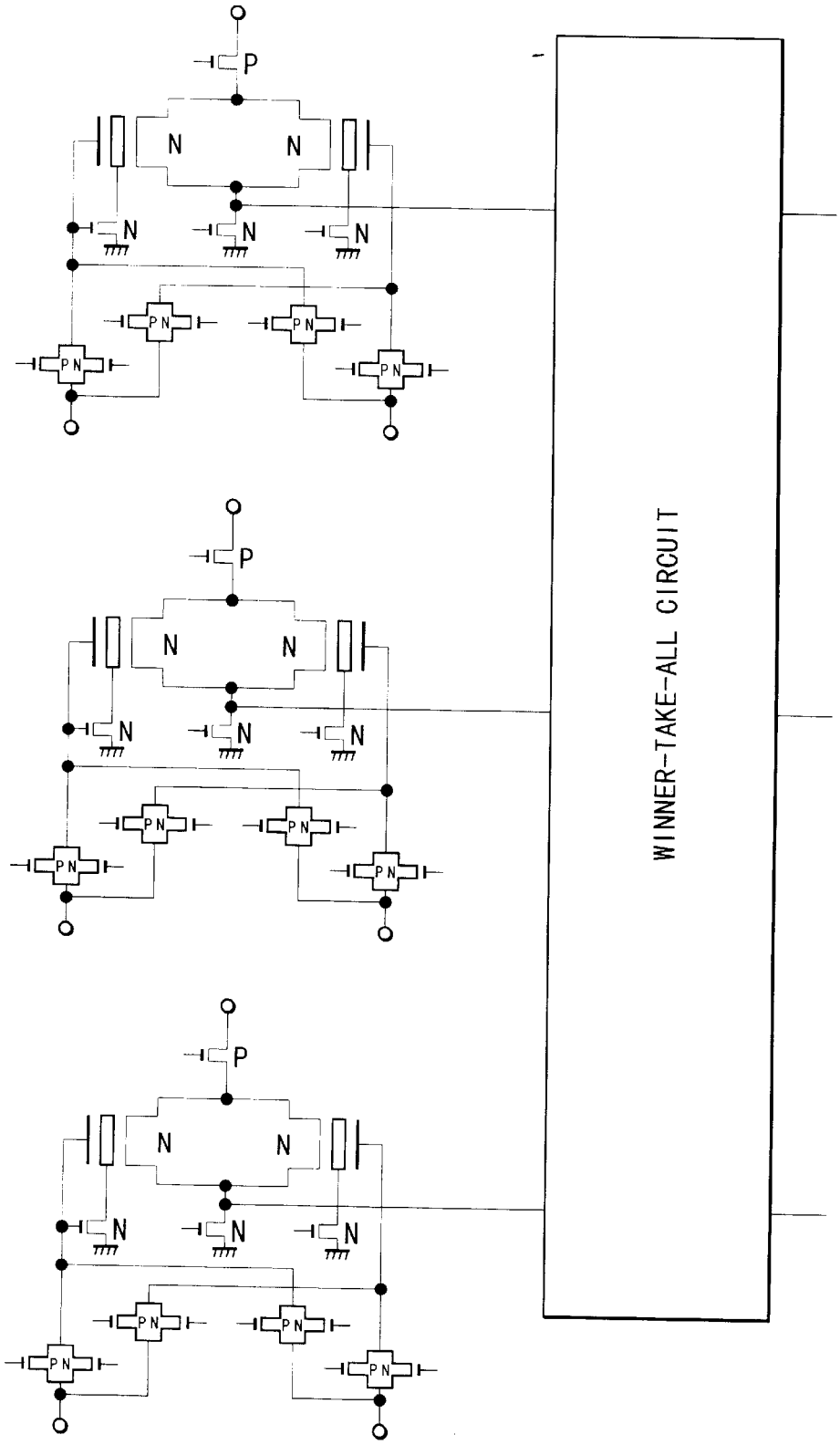
FIG. 13 is a circuit diagram relating to the eleventh embodiment.

FIG. 13 is a circuit diagram showing an eleventh embodiment. In this embodiment, a plurality of the difference absolute value circuits described in, for example, embodiment 1, are arranged, and by means of inputting the various outputs thereof into the input terminals of a winner-take-all circuit, the circuit calculates which result among the various calculation results of the difference absolute value circuits has the smallest value.

By means of combining this winner-take-all circuit with the difference absolute value circuits, it is possible to calculate which data among an enormous amount of data which have been accumulated are most similar to inputted data, at high speed and with a high degree of accuracy.

Furthermore, in the circuit structure shown here, three difference absolute value circuits and a three-input winner-take-all circuit are combined; however, it is of course the case that no problems will be caused no matter how many difference absolute value circuits are employed, if these are combined with a winner-take-all circuit having the same number of inputs. Furthermore, the difference absolute value circuits described in the first embodiment were employed as the difference absolute value circuits in this embodiment; however, with respect to this as well, it is the case that no problems will be caused even if the circuits described in the fifth, seventh, or ninth embodiments are employed. Additionally, the winner-take-all circuit described hereinbelow was employed as the winner-take-all circuit; however, it is of course the case that no problems will be caused if other circuits are employed in place of the winner-take-all circuit of this embodiment, insofar as these circuits have the same function.

Figure 15:
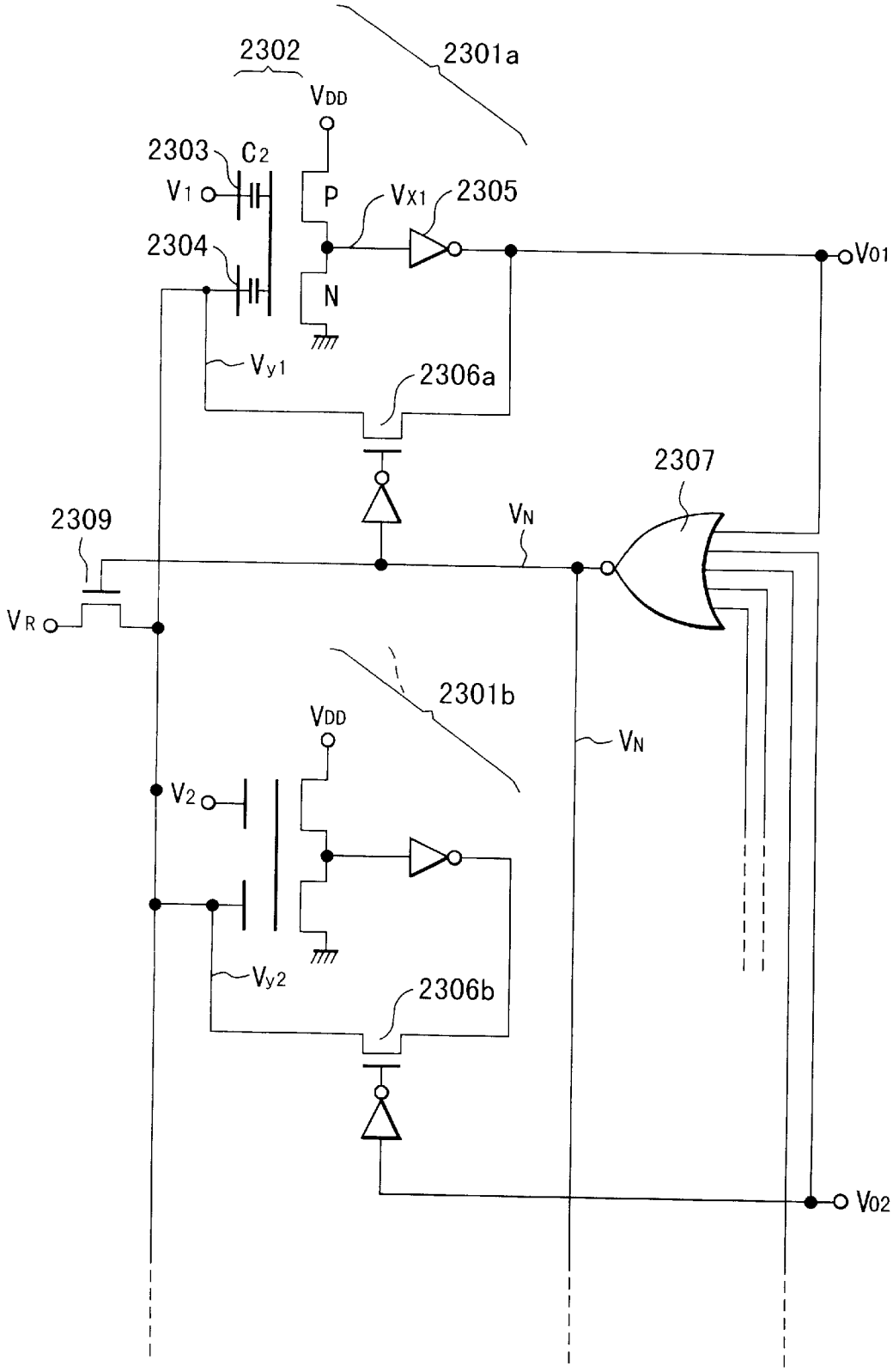
FIG. 15 is a schematic circuit diagram showing an example of a winner-take-all circuit which is preferably employed in the present invention.

A circuit having the structure shown in FIG. 15, for example, may be employed as the winner-take-all circuit in this example. The circuit shown in FIG. 15 is disclosed in Japanese Patent Application No. Hei 4-222166.

Twelfth Embodiment

Figure 14:
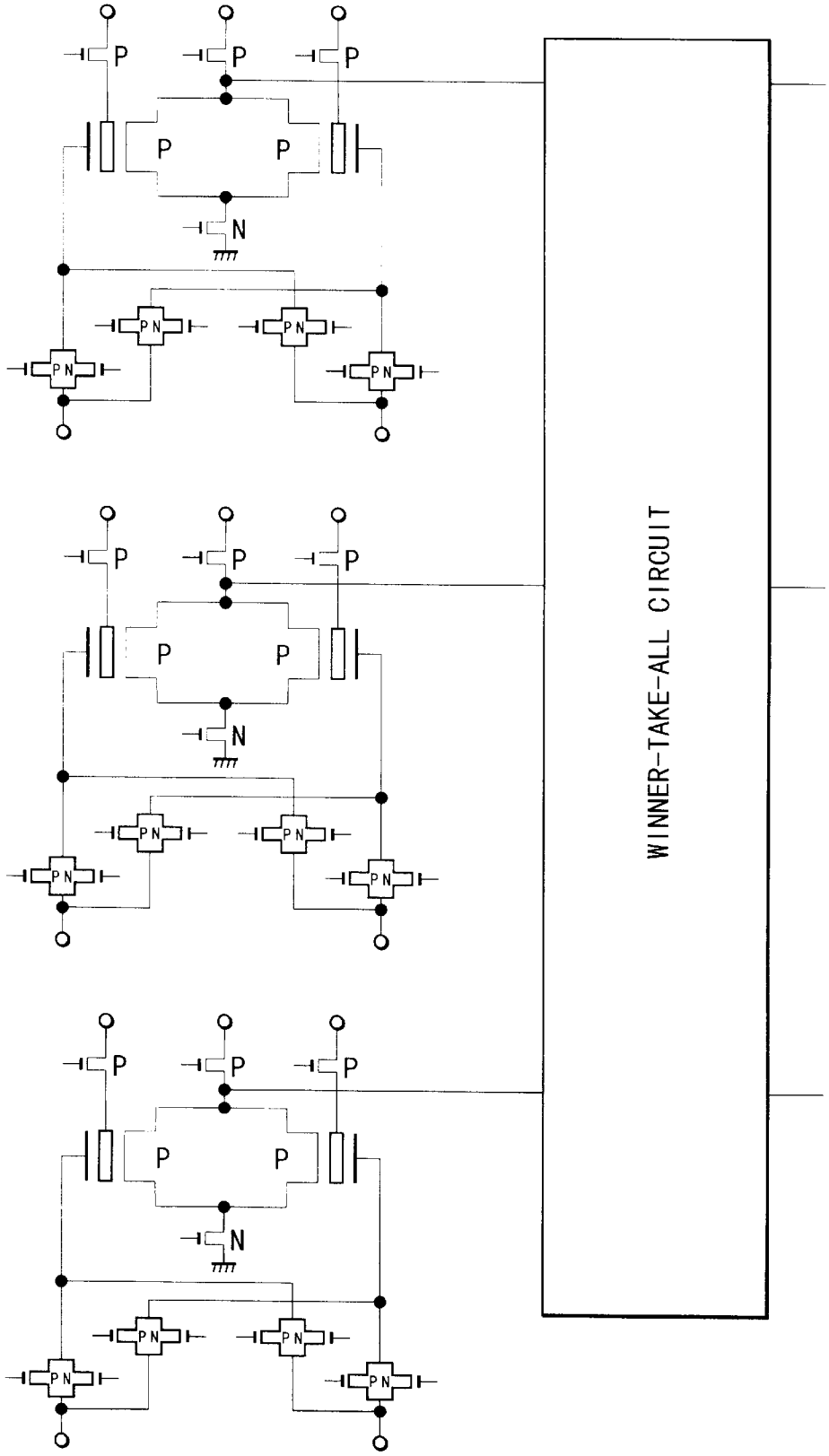
FIG. 14 is a circuit diagram relating to the twelfth embodiment.

FIG. 14 is a circuit diagram showing a twelfth embodiment. In this embodiment, a plurality of difference absolute value circuits described in, for example, the second embodiment, are arranged, and the various outputs thereof are inputted into the input terminals of a winner-take-all circuit, and thereby, the circuit calculates which of the results among the calculation results of the difference absolute value circuits has the largest value.

By means of combining this winner-take-all circuit with the difference absolute value circuits, it is possible to calculate which data among an enormous amount of data which have been accumulated are most similar to the data inputted, at high speed and with a high degree of accuracy.

Furthermore, the circuit structure was such that three difference absolute value circuits were combined with a three-input winner-take-all circuit; however, it is of course the case that no problems will be caused no matter how many difference absolute values are employed, insofar as a winner-take-all circuit having the same number of inputs is combined with the circuit. Furthermore, the difference absolute value circuits described in, for example, the second embodiment, were employed as the difference absolute value circuits in this embodiment; however, with respect to this as well, it is of course the case that no problems will be caused even if the circuits described in the fourth embodiment, the sixth embodiment, the eighth embodiment, or the tenth embodiment are employed. Additionally, with respect to the winner-take-all circuit, the winner-take-all circuit described hereinbelow was used; however, it is of course the case that no problems will be caused even if other circuits are employed in place of the winner-take-all circuit of this embodiment, insofar as these circuits have the same function.

Here, a circuit having the structure shown in FIG. 15 is employed as the winner-take-all circuit.

Thirteenth Embodiment

Figure 16:
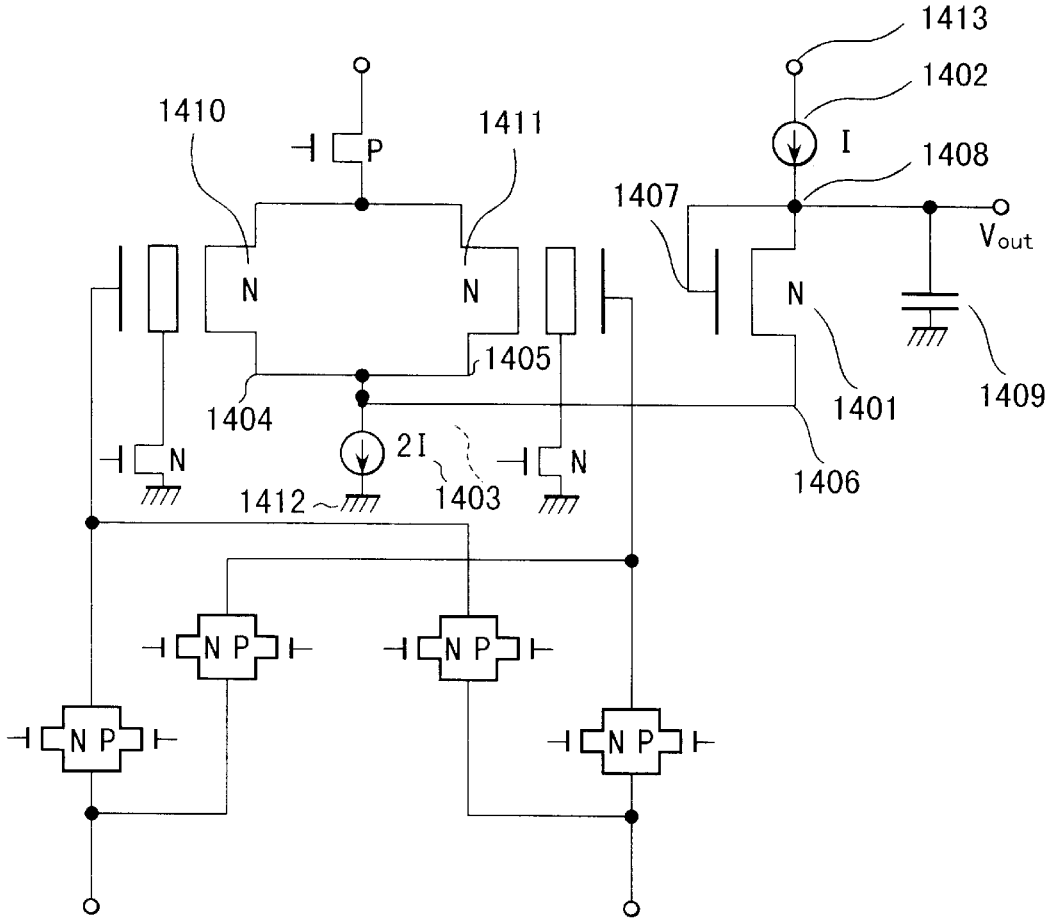
FIG. 16 is a circuit diagram showing a thirteenth embodiment.

FIG. 16 is a circuit diagram showing a thirteenth embodiment. The basic structure of this embodiment is almost the same as that of the first embodiment. In the first embodiment, the source electrodes 109 and 110 of NMOS transistors 101 and 102 were connected to one another, these were connected to an external capacitance load 125, and NMOS transistor 111 was employed as a switching element; however, here, a current source is employed in place of the NMOS transistor 111, and this is connected with a threshold drop cancel transistor and a current source. The basic operation is identical to that of the first embodiment, so that only those structures and basic principles which have changed will be discussed.

Threshold drop cancel transistor 1401 is a NMOS transistor, and the gate 1407 and drain 1408 thereof are directly connected to one another. In addition, gate 1407 and drain 1408 are connected with a power source potential 1413 via a current source 1402. Furthermore, gate 1407 and drain 1408 are connected to an external capacitance load 1409. The source electrode 1406 of threshold drop cancel transistor 1401 is connected to source electrodes 1404 and 1405 of NMOS transistors 1410 and 1411, and is connected to ground potential 1412 via current source 1403.

The gate length and width of the threshold cancel transistor 1401 is set to the same length as that of NMOS transistors 1410 and 1411, and furthermore, the design of these transistors is such that they are completely identical with respect to all other conditions. Furthermore, the current flowing to current source 1402 is represented by I, and the current flowing to current source 1403 is represented by 21. That is to say, the design is such that the current flowing to current source 1403 is twice that of the current flowing to current source 1402.

When the difference calculated on the gates of NMOS transistors 1401 and 1411 is read out in a source follower operation, the value read out is reduced by the amount of the threshold of the NMOS transistors. The reason for this is that even if the threshold values of the NMOS transistors are set to 0 V, the threshold fluctuates in an undesirable manner as a result of the substrate bias effect, so that it is extremely difficult to read out the difference calculated on the gates in an unchanged manner. By connecting the source electrode 1406 of a NMOS transistor designed in the same manner as NMOS transistors 1410 and 1411 to the source electrodes 1404 and 1405 of NMOS transistors 1410 and 1411, when the potential of drain electrode 1408 of NMOS transistor 1401, that is to say, the output voltage, reaches the potential of the source electrode 1406 raised by the threshold value of the NMOS transistors, NMOS transistor 1401 enters an OFF state, so that the source potential which has been reduced by the amount of the threshold values of NMOS transistors 1410 and 1411 is recovered, and appears in the output electrode. By means of this, it is possible to execute more accurate calculations.

Furthermore, a current source was employed here as the load connected to the source electrodes of NMOS transistors 1410 and 1411; however, by means of this, the source potentials of the NMOS transistors 1410 and 1411 are reduced from the difference calculated at the gates by an amount greater than the threshold values, since the operational point is determined by the current flowing to the load. With respect to this, by setting the current value of the current source 1403 to 2I, and the current value of the current source 1402 to I, the current flowing to NMOS transistors 1401, 1410, and 1411 is I, and this is equal to the current flowing to the threshold cancel transistor 1401, 50 that the source potential, which has further declined as a result of the current source because of the principle described above, appears in the output electrode in a recovered form.

Accordingly, it becomes possible to conduct analog calculations with a higher degree of accuracy. However, the size of the threshold drop cancel transistor 1401 was designed under the same conditions as NMOS transistors 1410 and 1411, and furthermore, the current flowing to current sources 1402 and 1403 was set at, respectively, I and 2I; however, it is not necessarily the case that the design described above must be followed in the actual process of design, and the design may be different in certain cases.

Here, the structure of the current source is not particularly restricted. This is because no problems will be caused insofar as the structure is that of a current source. Furthermore, no problems will caused in the effects of the present invention if other circuitry is added to maintain the ratio of the current flowing to the current sources 1402 and 1403. The circuitry described in the first embodiment was employed as the circuitry which calculates the difference; however, it is of course the case that no problems will caused if the circuitry of the third or fifth embodiments is employed. Furthermore, it is of course the case that no problems will be caused even if the circuitry described in the seventh, ninth, or eleventh embodiments is employed as the circuitry used in this embodiment.

Fourteenth Embodiment

Figure 17:
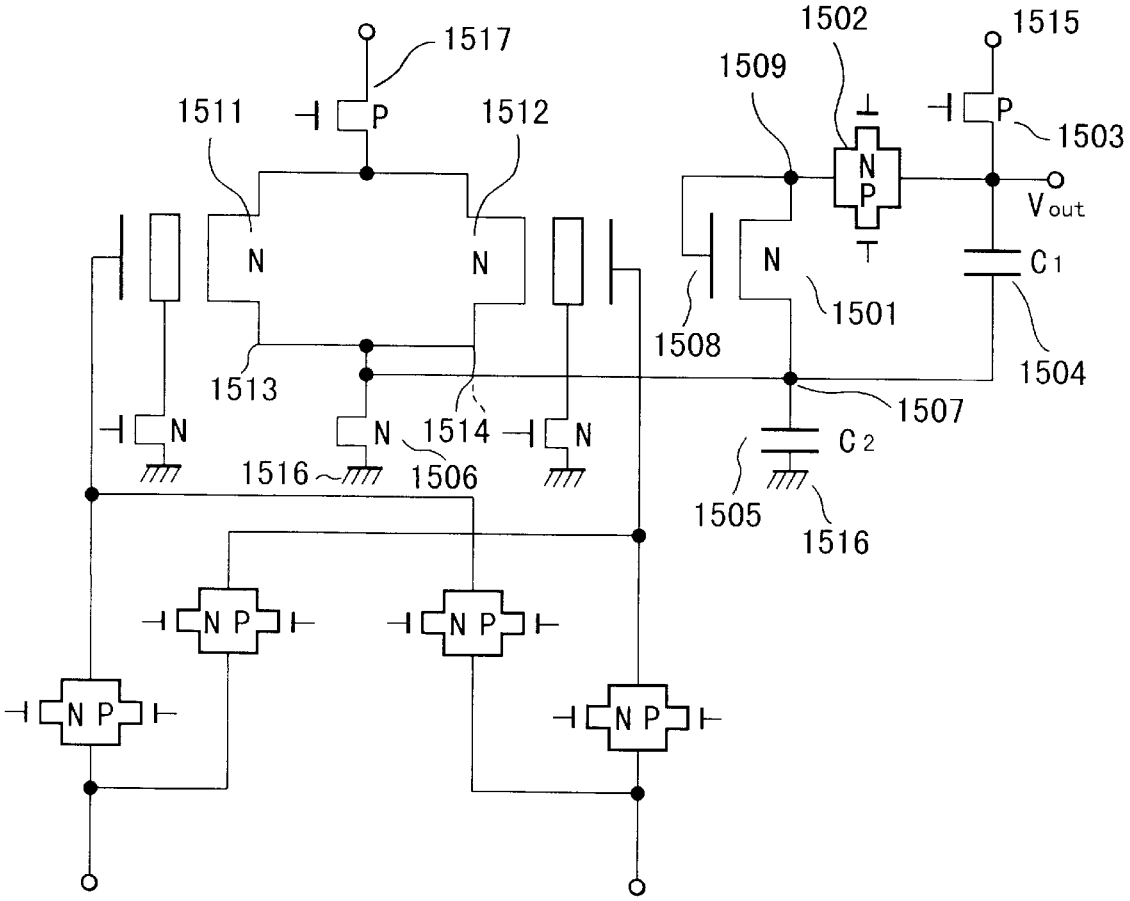
FIG. 17 is a circuit diagram showing a fourteenth embodiment.

FIG. 17 is a circuit diagram showing a fourteenth embodiment. The basic structure of this embodiment is almost identical to that of the thirteenth embodiment. In the thirteenth embodiment, the source electrodes 1404 and 1405 of NMOS transistors 1410 and 1411 are connected to one another, and are connected to a current source 1403, and are further connected to a threshold drop cancel transistor 1401; however, here, in place of the current source used in the thirteenth embodiment, a capacitor and switching element realize the same functions. The basic operating principle is identical to that of the thirteenth embodiment, and the structure and operating principle of only those portions which have changed will be explained.

Threshold drop cancel transistor 1501 is a NMOS transistor, and the gate 1508 and drain 1509 thereof are directly connected to one another. In addition, gate 1508 and drain 1809 are connected to output electrode 1510 via a switching element 1502. Furthermore, output electrode 1510 is connected to a power source potential 1515 via a switching element 1503, and is further connected to the source electrode 1507 of threshold drop cancel transistor 1501 via capacitor 1504. In addition, the source electrode 1507 of the threshold drop cancel transistor 1501 is connected to source electrodes 1513 and 1514 of NMOS transistors 1511 and 1512, and is further connected to ground potential 1516 via capacitor 1505, while at the same time being connected to ground potential 1516 via switching element 1516. The gate length and gate width of this threshold drop cancel transistor 1501 is set to, for example, the same length as those of NMOS transistors 1511 and 1512, and furthermore, these transistors are designed so as to be completely identical with respect to all other conditions.

With respect to the circuit operation, by means of placing the switching element 1517 in an ON state and placing the switching element 1506 in an OFF state, NMOS transistors 1511 and 1512 conduct a source follower operation, so that the difference calculated on the gates can be read out to capacitor 1505. At this time, switching element 1502 is placed in an OFF state, and switching element 1503 is placed in an ON state, and capacitor 1504 is set to a potential equal to the specified power source voltage. After this, when switching element 1503 is placed in an OFF state, and switching element 1502 is placed in an ON state, with respect to the threshold drop cancel transistor 1501, the gate and drain electrodes thereof are at the power source voltage, while the source electrode is at the potential of the difference, so that the power source voltage is higher, the transistor enters an ON state, and a current flows from drain electrode 1509 to source electrode 1507. Subsequently, when the potential of the drain electrode reaches, from the power source voltage, a point at which it is increased by the threshold value of the transistor from the source electrode potential, then threshold cancel transistor 1501 enters an OFF state, and drain electrode 1509 is fixed at a potential increased by the threshold value of the transistor compared to the source electrode 1507. That is to say, drain electrode 1509 is connected to output electrode 1510 via switching element 1502, so that the output voltage may be outputted in such a manner that the value of the difference, which was decreased by the thresholds of NMOS transistors 1511 and 1512, is recovered by the same threshold values. By means of this, it becomes possible to execute more accurate calculations. Furthermore, with respect to the capacitance of the capacitor employed here, if the capacitance of capacitor 1504 is represented by $C_1$, and the capacitance of capacitor 1505 is represented by $C_2$, it is necessary to be careful with respect to the size of $C_1$ and $C_2$ in order to maintain accuracy. The reason for this is that the charge stored in advance in capacitor 1504 flows into capacitor 1505 and the potential of drain 1509 is reduced, and thereby, the output potential is determined; if $C_1$ is assumed to have a value larger than $C_2$, then the change in potential of source electrodes 1507, 1513, and 1514 resulting from the charge flowing into capacitor 1505 becomes impossible to ignore, and if it is assumed that the potential rises, the NMOS transistors 1511 and 1512 will enter an OFF state earlier by the amount of this rise, and there is a danger that it will become impossible to read out the value of the difference calculated on the gates in an accurate manner. Accordingly, it is necessary to take this fact into consideration when conducting the actual design, and to thus determine the size of the capacitance of the capacitors. Here, a CMOS transmission gate, a PMOS transistor, and a NMOS transistor were employed as switching elements 1502, 1503, and 1506; however, this is not necessarily restricted to the switching elements described, and no problems will be caused if other switching elements are employed, insofar as the operation is correct. Furthermore, the circuit described in the first embodiment was employed as the circuit which calculates the value of the difference; however, it is of course the case that no problems will be caused if the circuits of the third or fifth embodiments are employed. Furthermore, it is of course the case that no problems will be caused even if the circuits in the seventh embodiment, ninth embodiment, or eleventh embodiment are employed as the circuit in this embodiment.

Fifteenth Embodiment

Figure 18:
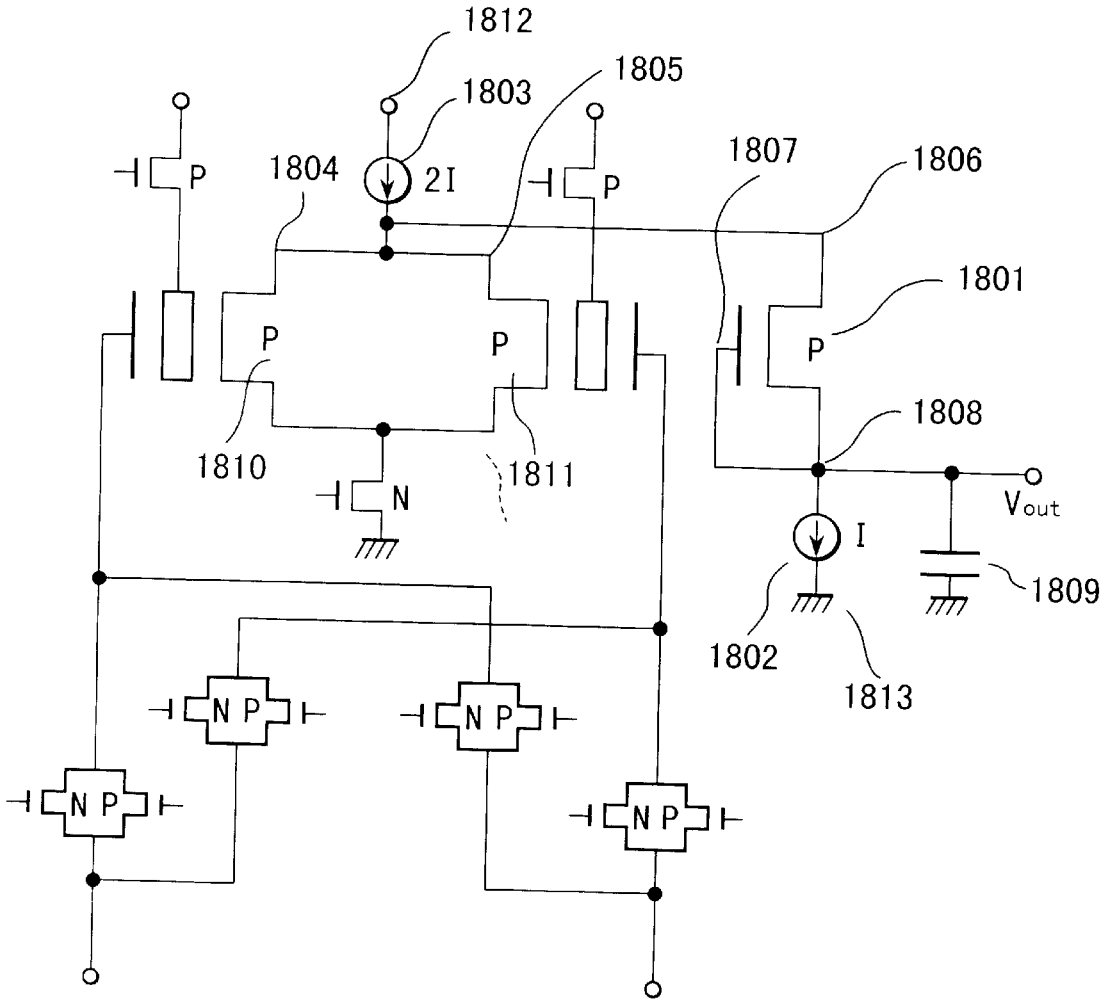
FIG. 18 is a circuit diagram showing a fifteenth embodiment.
Figure 19:
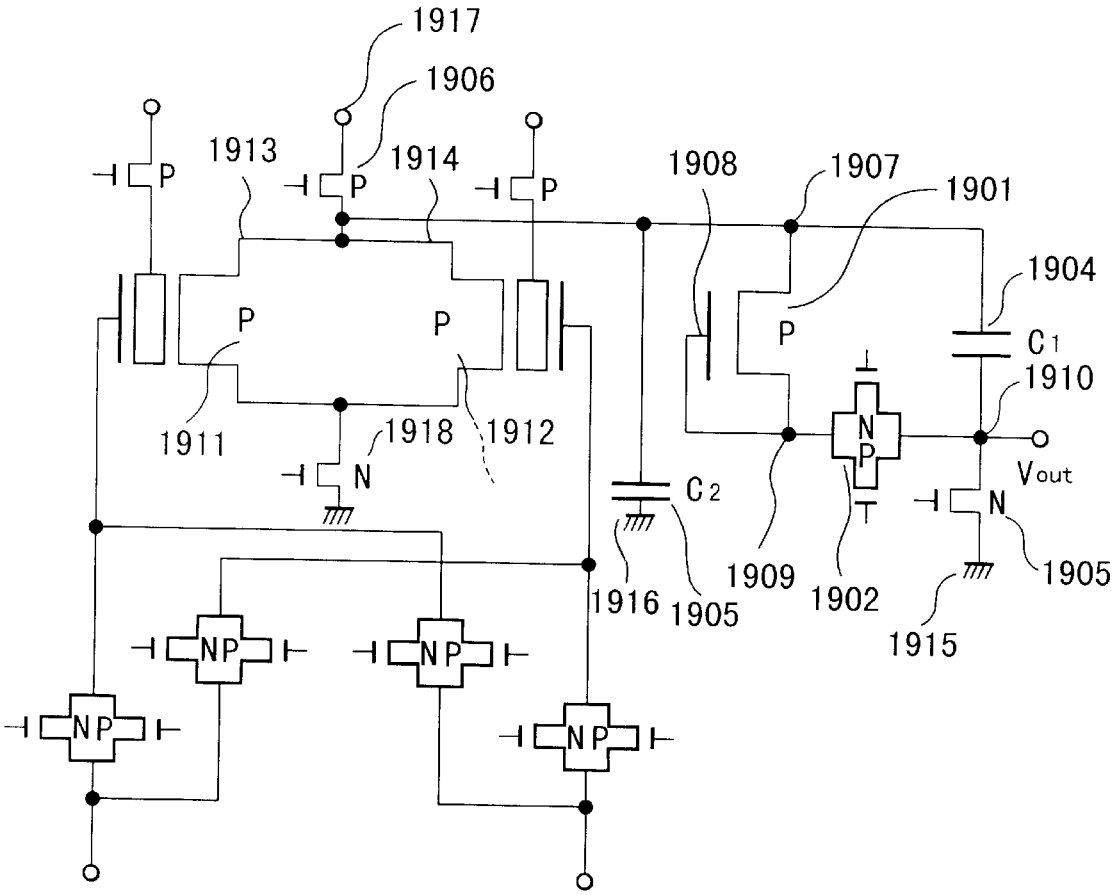
FIG. 19 is a circuit diagram showing a sixteenth embodiment.

FIG. 18 is a circuit diagram showing a fifteenth embodiment. The basic structure of this embodiment is essentially identical to that of the second embodiment. In the second embodiment, the source electrodes 309 and 310 of PMOS transistors 301 and 302 were connected to one another, and these were also connected to an external capacitance load 325, and PMOS transistor 311 was used as a switching element; however, here, a current source is employed in place of the PMOS transistor 311, and a threshold drop cancel transistor is connected with a current source. The basic operation is identical to that of the second embodiment, so that only the structure and operation principle of those portions which are changed which will be described here.

Threshold drop cancel transistor 1801 is a PMOS transistor, angel the gate 1807 and drain 1808 thereof are directly connected to one another. In addition, gate 1807 and drain 1808 are connected to the ground potential 1813 via a current source 1802. Furthermore, gate 1807 and drain 1808 are connected to an external capacitance load 1809. The source electrode 1806 of the threshold drop cancel transistor 1801 is connected to the source electrodes 1804 and 1805 of PMOS transistors 1810 and 1811, and is connected to power source potential 1812 via current source 1803. The gate length and gate width of this threshold cancel transistor 1801 are set to the same length as those of PMOS transistors 1810 and 1811, and these transistors are completely identical with respect to all other conditions. Furthermore, the current value flowing to current source 1802 is set to I, while the current value flowing to current source 1803 is set to 2I. That is to say, the current flowing to current source 1803 is set so as to be twice the current flowing to current source 1802.

The value of the difference calculated on the gates of PMOS transistors 1810 and 1811 is read out in a source follower operation, and at this time, this read-out value is lowered by the amount of the thresholds of the PMOS transistors. This is done so because, even if the threshold of the PMOS transistors is set to 0 V, the threshold changes in an undesirable manner as a result of the substrate bias effect, so that it is extremely difficult to read out the value of the difference calculated on the gates in an unchanged manner. By means of designing the PMOS transistors 1810 and 1811 in the same manner as the PMOS transistor, and by connecting the source electrode 1806 of the PMOS transistor to the source electrodes 1804 and 1805 of the PMOS transistors 1810 and 1811, at the potential of drain electrode 1808 of PMOS transistor 1801, that is to say, at a potential at which the output voltage has increased higher than the potential of the source electrode 1806 by the amount of the threshold of the PMOS transistor, PMOS transistor 1801 enters an OFF state, so that the source potential, which has been reduced by the amount of the threshold of PMOS transistors 1810 and 1811, is recovered, and appears in the output electrode. By means of this, it is possible to conduct more accurate calculations.

Furthermore, a current source was used here as the load connected to the source electrodes of PMOS transistors 1810 and 1811; however, as a result of this, the source potential of PMOS transistors 1810 and 1811 is reduced from the amount of the value of the difference calculated on the gates by an amount greater than the threshold value, since the operational point is determined by the current value flowing to the load. With respect to this, the current value of current source 1803 is set to 2I, and the current value of current source 1802 is set to I, and thereby, the value of the current flowing to PMOS transistors 1801, 1810, and 1811 becomes I, and becomes equal to the current flowing to threshold cancel transistor 1801, so that by means of a principle similar to the principle mentioned above, the source potential, which has been further reduced as a result of the current source, appears in the output electrode in a recovered state.

Accordingly, it becomes possible to conduct more accurate analog calculations. Here, the size of the threshold drop cancel transistor 1801 was set to conditions identical to those of PMOS transistors 1810 and 1811, and furthermore, the current flowing to current sources 1802 and 1803 was set to, respectively, I and 2I; however, it is not the case that the design must necessarily be as described above during the actual design, and this may be different in certain cases.

Here, the structure of the current sources is not particularly restricted. This is because no particular problems will be caused. insofar as the structure is one which serves as a current source. Furthermore, there will no change in the effect of the present invention even if other circuitry is appended in order to stabilize the ratio of the currents flowing to current sources 1802 and 1803. Additionally, the circuit described in the second embodiment was employed as the circuit which calculates the value of the difference; however, it is of course the case that no problems will be caused even if the circuitry of the fourth embodiment or sixth embodiment is employed. Furthermore, it is of course the case that no problems will be caused even if the circuits described in the eighth embodiment, the tenth embodiment, or the twelfth embodiment are employed as the circuits described in this embodiment.

Sixteenth Embodiment

Figure nineteen is a circuit diagram showing a sixteenth embodiment. The basic structure of this embodiment is almost identical to that of the fifteenth embodiment. In the fifteenth embodiment, source electrodes 1804 and 1805 of PMOS transistors 1810 and 1811 were connected to one another, and these were connected to a current source 1803, and connected to a threshold drop cancel transistor 1801; however, here, in place of the current source used in the fifteenth embodiment, a similar function is realized using a capacitor and a switching element. The basic operational principle is identical to that of the fifteenth embodiment, so that only the structure and operational principle of those portions which have changed will be discussed.

Threshold drop cancel transistor 1901 is a PMOS transistor, and the gate 1908 and drain 1909 thereof are directly connected to one another. Additionally, gate 1908 and drain 1909 are connected to an output electrode 1910 via a switching element 1902. Furthermore, output electrode 1910 is connected with ground potential 1915 via switching element 1903, and is connected with source electrode 1907 of threshold drop cancel transistor 1901 via capacitor 1904. Additionally, the source electrode 1907 of threshold drop cancel transistor 1901 is connected to source electrodes 1913 and 1914 of PMOS transistors 1911 and 1912, and is connected to ground potential 1916 via a capacitor 1905, while simultaneously being connected to power source potential 1917 via switching element 1906. The gate length and gate width of this threshold drop cancel transistor 1901 are set to the same length as those of PMOS transistors 1911 and 1912, and furthermore, these transistors are designed so as to be completely identical with respect to all other conditions.

With respect to the operation of the circuit, by means of placing switching element 1918 in a ON state, and placing switching element 1906 in an OFF state, PMOS transistors 1911 and 1912 conduct a source follower operation, so that the value of the difference calculated on the gates can be outputted to capacitor 1905. At this time, switching element 1902 is placed in an OFF state, and switching element 1903 is placed in an ON state, and capacitor 1904 is set to a potential equal to the ground voltage. After this, when switching element 1903 is placed in OFF state, and switching element 1902 is placed in an ON state, with respect to the threshold drop cancel transistor 1901, the gate and drain electrodes thereof are at the ground voltage, and the source electrode has a potential which is the value of the difference, so that the voltage of the difference is higher, the transistor enters an ON state, and current flows from source electrode 1907 to drain electrode 1909. Subsequently, when the potential of the drain electrode increases by the amount of the threshold of the transistor from the ground potential as a result of the source electrode potential, threshold cancel transistor 1901 enters an OFF state, so that drain 1909 is fixed at a potential which is higher than that of the source electrode 1907 by the threshold of the transistor. That is to say, drain electrode 1909 and output electrode 1910 are connected via a switching element 1902, so that output of the output voltage is possible in which the value of the difference, which has been reduced by the amount of the thresholds of the PMOS transistors 1911 and 1912, is recovered by the same threshold amount. By means of this, it is possible to execute more accurate operations.

Furthermore, with respect to the size of the capacitance of the capacitor used here, if the capacitance of capacitor 1904 is set at $C_1$, and the capacitance of capacitor 1905 is set at $C_2$, then it is necessary to be careful with respect to size of $C_1$ and $C_2$ in order to maintain accuracy. This is because the charge stored in advance in capacitor 1904 flows into capacitor 1905, and the potential of drain electrode 1909 is reduced, thereby determining the output potential; however, if it is assumed that $C_1$ has a value larger than that of $C_2$, then the change in the potentials of source electrodes 1907, 1913, and 1914 as a result of the charge flowing into capacitor

1905 can no longer be ignored, and if it is assumed that the potential decreases, PMOS transistors 1911 and 1912 will enter an OFF state more quickly in proportion to the amount by which the potential has declined, and there is thus a danger that the value of the difference calculated on the gates can no longer be read out accurately. Accordingly, this should be taken into account when the actual design is undertaken, and the size of the capacities of the capacitors should be determined in accordance with this.

Here, a CMOS transmission gate, a NMOS transistor, and a PMOS transistor were employed as switching elements 1902, 1903, and 1906; however, this is not necessarily limited to these switching elements, and no problems will be caused if other switching elements are employed insofar the operation is correct. Furthermore, the circuit described in the second embodiment was employed as the circuit which calculates the value of the difference; however, it is of course the case that no problems will be caused even if the circuits described in the fourth embodiment or sixth embodiment are employed. Furthermore, it is of course the case that no problems will be caused even if the circuits described in the eighth embodiment, the tenth embodiment, or the twelfth embodiment are employed as the circuits in this embodiment.

With the invention, it has become possible to conduct analog vector calculations at extremely high speed and with a high degree of accuracy by providing switching elements at gate electrodes, and switching the input, without requiring complicated control circuitry.

What is claimed is:

1. A semiconductor arithmetic circuit comprising:

a signal line having a prescribed potential;

a plurality of switching elements;

at least two MOS type transistors, each having gate electrodes, input electrodes, and source electrode, said source electrodes connected to one another, said gate electrodes connected to said signal line via said switching elements, and at least one said input electrode capacitively coupled to each of said gate electrodes;

means for applying first and second input voltages, respectively, to said input electrodes of said at least two MOS type transistors and equalizing potentials of said gate electrodes to the potential of said signal line by causing said switching elements to conduct; and means for inputting said second and first input voltages to, respectively, the input electrodes of said at least two MOS type transistors after placing said gate electrodes in an electrically floating state by turning said switching elements off.

2. A semiconductor arithmetic circuit in accordance with claim one, wherein said at least two MOS type transistors are N channel MOS type transistors, and said signal line is connected to a ground potential.

3. A semiconductor arithmetic circuit in accordance with claim one, wherein said MOS type transistors are P channel MOS type transistors, and said signal line is connected to a positive power source line.

4. A semiconductor arithmetic circuit in accordance with claim 1, wherein said source electrodes are connected to a capacitance load, and a further switching element which sets the potential of said source electrodes to a ground potential is provided.

5. A semiconductor arithmetic circuit in accordance with claim 1, wherein said source electrodes are connected to a capacitance load, and a further switching element is provided which sets the potential of said source electrodes to the potential of a positive power source.

6. A semiconductor arithmetic circuit in accordance with claim 2, wherein said source electrodes are connected to a capacitance load, and a further switching element which sets the potential of said source electrodes to the ground potential is provided.

7. A semiconductor arithmetic circuit in accordance with claim 2, wherein said source electrodes are connected to a capacitance load, and a further switching element is provided which sets the potential of said source electrodes to the potential of a positive power source.

8. A semiconductor arithmetic circuit in accordance with claim 3, wherein said source electrodes are connected to a capacitance load, and a further switching element is provided which sets the potential of said source electrodes to the potential of the positive power source.

* * * * *